US011534651B2

(12) United States Patent
Ercanbrack et al.

(10) Patent No.: US 11,534,651 B2
(45) Date of Patent: Dec. 27, 2022

(54) ADJUSTABLE DUMBBELL SYSTEM

(71) Applicant: iFIT Inc., Logan, UT (US)

(72) Inventors: Gaylen Ercanbrack, Logan, UT (US); Michael Olson, Providence, UT (US)

(73) Assignee: iFIT Inc., Logan, UT (US)

( * ) Notice: Subject to any disclaimer, the term of this patent is extended or adjusted under 35 U.S.C. 154(b) by 57 days.

(21) Appl. No.: 16/992,870

(22) Filed: Aug. 13, 2020

(65) Prior Publication Data

US 2021/0046351 A1 Feb. 18, 2021

Related U.S. Application Data

(60) Provisional application No. 62/887,391, filed on Aug. 15, 2019.

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726; A63B 21/0728; A63B 21/072–075; A63B 71/0036
See application file for complete search history.

(56) References Cited

U.S. PATENT DOCUMENTS 3,123,646 A 3/1964 Easton
3,579,339 A 5/1971 Chang
4,023,795 A 5/1977 Pauls
4,300,760 A 11/1981 Bobroff
D286,311 S 10/1986 Martinell
4,681,318 A 7/1987 Lay
4,684,126 A 8/1987 Dalebout
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet
4,850,585 A 7/1989 Dalebout
D304,849 S 11/1989 Watterson
4,880,225 A 11/1989 Lucas
4,883,272 A 11/1989 Lay
D306,468 S 3/1990 Watterson
D306,891 S 3/1990 Watterson
4,913,396 A 4/1990 Dalebout
D307,614 S 5/1990 Bingham
(Continued)

OTHER PUBLICATIONS

U.S. Appl. No. 29/702,127, filed Sep. 16, 2019, Gordon Cutler.
(Continued)

*Primary Examiner* — Garrett K Atkinson
*Assistant Examiner* — Kathleen M Fisk
(74) *Attorney, Agent, or Firm* — Ray Quinney & Nebeker P.C.; Paul N. Taylor

(57) ABSTRACT

An adjustable dumbbell includes weight plates that are selectively connectable to a handle. Unselected weight plates are secured to a cradle. To secure the unselected weight plates to the cradle, a latch in the cradle is inserted into an engagement surface notch in the weight plate. The unselected weight plates are individually actuated based on which weight plates are selected and connected to the handle.

20 Claims, 16 Drawing Sheets

(56) References Cited

U.S. PATENT DOCUMENTS

| | | | |
|---|---|---|---|
| D307,615 | S | 5/1990 | Bingham |
| 4,921,242 | A | 5/1990 | Watterson |
| 4,932,650 | A | 6/1990 | Bingham |
| D309,167 | S | 7/1990 | Griffin |
| D309,485 | S | 7/1990 | Bingham |
| 4,938,478 | A | 7/1990 | Lay |
| D310,253 | S | 8/1990 | Bersonnet |
| 4,955,599 | A | 9/1990 | Bersonnet |
| 4,971,316 | A | 11/1990 | Dalebout |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout |
| D315,765 | S | 3/1991 | Measom |
| 4,998,725 | A | 3/1991 | Watterson |
| 5,000,442 | A | 3/1991 | Dalebout |
| 5,000,443 | A | 3/1991 | Dalebout |
| 5,000,444 | A | 3/1991 | Dalebout |
| D316,124 | S | 4/1991 | Dalebout |
| 5,013,033 | A | 5/1991 | Watterson |
| 5,014,980 | A | 5/1991 | Bersonnet |
| 5,016,871 | A | 5/1991 | Dalebout |
| D318,085 | S | 7/1991 | Jacobson |
| D318,086 | S | 7/1991 | Bingham |
| D318,699 | S | 7/1991 | Jacobson |
| 5,029,801 | A | 7/1991 | Dalebout |
| 5,034,576 | A | 7/1991 | Dalebout |
| 5,058,881 | A | 10/1991 | Measom |
| 5,058,882 | A | 10/1991 | Dalebout |
| D321,388 | S | 11/1991 | Dalebout |
| 5,062,626 | A | 11/1991 | Dalebout |
| 5,062,627 | A | 11/1991 | Bingham |
| 5,062,632 | A | 11/1991 | Dalebout |
| 5,062,633 | A | 11/1991 | Engel |
| 5,067,710 | A | 11/1991 | Watterson |
| 5,072,929 | A | 12/1991 | Peterson |
| D323,009 | S | 1/1992 | Dalebout |
| D323,198 | S | 1/1992 | Dalebout |
| D323,199 | S | 1/1992 | Dalebout |
| D323,863 | S | 2/1992 | Watterson |
| 5,088,729 | A | 2/1992 | Dalebout |
| 5,090,694 | A | 2/1992 | Pauls |
| 5,102,380 | A | 4/1992 | Jacobson |
| 5,104,120 | A | 4/1992 | Watterson |
| 5,108,093 | A | 4/1992 | Watterson |
| D326,491 | S | 5/1992 | Dalebout |
| 5,122,105 | A | 6/1992 | Engel |
| 5,135,216 | A | 8/1992 | Bingham |
| 5,147,265 | A | 9/1992 | Pauls |
| 5,149,084 | A | 9/1992 | Dalebout |
| 5,149,312 | A | 9/1992 | Croft et al. |
| 5,171,196 | A | 12/1992 | Lynch |
| D332,347 | S | 1/1993 | Raadt |
| 5,190,505 | A | 3/1993 | Dalebout |
| 5,192,255 | A | 3/1993 | Dalebout |
| 5,195,937 | A | 3/1993 | Engel |
| 5,203,826 | A | 4/1993 | Dalebout |
| D335,511 | S | 5/1993 | Engel |
| D335,905 | S | 5/1993 | Cutter |
| D336,498 | S | 6/1993 | Engel |
| 5,217,487 | A | 6/1993 | Engel |
| D337,361 | S | 7/1993 | Engel |
| D337,666 | S | 7/1993 | Peterson |
| D337,799 | S | 7/1993 | Cutter |
| 5,226,866 | A | 7/1993 | Engel |
| 5,244,446 | A | 9/1993 | Engel |
| 5,247,853 | A | 9/1993 | Dalebout |
| 5,259,611 | A | 11/1993 | Dalebout |
| D342,106 | S | 12/1993 | Campbell |
| 5,279,528 | A | 1/1994 | Dalebout |
| D344,112 | S | 2/1994 | Smith |
| D344,557 | S | 2/1994 | Ashby |
| 5,282,776 | A | 2/1994 | Dalebout |
| 5,295,931 | A | 3/1994 | Dreibelbis |
| 5,302,161 | A | 4/1994 | Loubert |
| D347,251 | S | 5/1994 | Dreibelbis |
| 5,316,534 | A | 5/1994 | Dalebout |
| D348,493 | S | 7/1994 | Ashby |
| D348,494 | S | 7/1994 | Ashby |
| 5,328,164 | A | 7/1994 | Soga |
| D349,931 | S | 8/1994 | Bostic |
| 5,336,142 | A | 8/1994 | Dalebout |
| 5,344,376 | A | 9/1994 | Bostic |
| D351,202 | S | 10/1994 | Bingham |
| D351,435 | S | 10/1994 | Peterson |
| D351,633 | S | 10/1994 | Bingham |
| D352,534 | S | 11/1994 | Dreibelbis |
| D353,422 | S | 12/1994 | Bostic |
| 5,372,559 | A | 12/1994 | Dalebout |
| 5,374,228 | A | 12/1994 | Buisman |
| 5,382,221 | A | 1/1995 | Hsu |
| 5,387,168 | A | 2/1995 | Bostic |
| 5,393,690 | A | 2/1995 | Fu |
| D356,128 | S | 3/1995 | Smith |
| 5,409,435 | A | 4/1995 | Daniels |
| 5,429,563 | A | 7/1995 | Engel |
| 5,431,612 | A | 7/1995 | Holden |
| D360,915 | S | 8/1995 | Bostic |
| 5,468,205 | A | 11/1995 | McFall |
| 5,489,249 | A | 2/1996 | Brewer |
| 5,492,517 | A | 2/1996 | Bostic |
| D367,689 | S | 3/1996 | Wilkinson |
| 5,511,740 | A | 4/1996 | Loubert |
| 5,512,025 | A | 4/1996 | Dalebout |
| D370,949 | S | 6/1996 | Furner |
| D371,176 | S | 6/1996 | Furner |
| 5,527,245 | A | 6/1996 | Dalebout |
| 5,529,553 | A | 6/1996 | Finlayson |
| 5,540,429 | A | 7/1996 | Dalebout |
| 5,549,533 | A | 8/1996 | Olson |
| 5,554,085 | A | 9/1996 | Dalebout |
| 5,569,128 | A | 10/1996 | Dalebout |
| 5,591,105 | A | 1/1997 | Dalebout |
| 5,591,106 | A | 1/1997 | Dalebout |
| 5,595,556 | A | 1/1997 | Dalebout |
| 5,607,375 | A | 3/1997 | Dalebout |
| 5,611,539 | A | 3/1997 | Watterson |
| 5,622,527 | A | 4/1997 | Watterson |
| 5,626,538 | A | 5/1997 | Dalebout |
| 5,626,542 | A | 5/1997 | Dalebout |
| D380,024 | S | 6/1997 | Novak |
| 5,637,059 | A | 6/1997 | Dalebout |
| D380,509 | S | 7/1997 | Wilkinson |
| 5,643,153 | A | 7/1997 | Nylen |
| 5,645,509 | A | 7/1997 | Brewer |
| D384,118 | S | 9/1997 | Deblauw |
| 5,662,557 | A | 9/1997 | Watterson |
| 5,669,857 | A | 9/1997 | Watterson |
| 5,672,140 | A | 9/1997 | Watterson |
| 5,674,156 | A | 10/1997 | Watterson |
| 5,674,453 | A | 10/1997 | Watterson |
| 5,676,624 | A | 10/1997 | Watterson |
| 5,683,331 | A | 11/1997 | Dalebout |
| 5,683,332 | A | 11/1997 | Watterson |
| D387,825 | S | 12/1997 | Fleck |
| 5,695,433 | A | 12/1997 | Buisman |
| 5,695,434 | A | 12/1997 | Dalebout |
| 5,695,435 | A | 12/1997 | Dalebout |
| 5,702,325 | A | 12/1997 | Watterson |
| 5,704,879 | A | 1/1998 | Watterson |
| 5,718,657 | A | 2/1998 | Dalebout et al. |
| 5,720,200 | A | 2/1998 | Anderson |
| 5,720,698 | A | 2/1998 | Dalebout |
| D392,006 | S | 3/1998 | Dalebout |
| 5,722,922 | A | 3/1998 | Watterson |
| 5,733,229 | A | 3/1998 | Dalebout |
| 5,743,833 | A | 4/1998 | Watterson |
| 5,762,584 | A | 6/1998 | Daniels |
| 5,762,587 | A | 6/1998 | Dalebout |
| 5,772,560 | A | 6/1998 | Watterson |
| 5,810,698 | A | 9/1998 | Hullett |
| 5,827,155 | A | 10/1998 | Jensen |
| 5,830,114 | A | 11/1998 | Halfen |
| 5,860,893 | A | 1/1999 | Watterson |

(56) References Cited

U.S. PATENT DOCUMENTS 5,860,894 A 1/1999 Dalebout
5,899,834 A 5/1999 Dalebout
D412,953 S 8/1999 Armstrong
D413,948 S 9/1999 Dalebout
5,951,441 A 9/1999 Dalebout
5,951,448 A 9/1999 Bolland
D416,596 S 11/1999 Armstrong
6,003,166 A 12/1999 Hald
6,019,710 A 2/2000 Dalebout
6,027,429 A 2/2000 Daniels
6,033,347 A 3/2000 Dalebout et al.
D425,940 S 5/2000 Halfen
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,228,003 B1 * 5/2001 Hald ..... A63B 21/0728 482/107
6,238,323 B1 5/2001 Simonson
6,251,052 B1 6/2001 Simonson
6,261,022 B1 * 7/2001 Dalebout ..... A63B 21/075 482/107
6,280,362 B1 8/2001 Dalebout et al.
6,296,594 B1 10/2001 Simonson
D450,872 S 11/2001 Dalebout
6,312,363 B1 11/2001 Watterson
D452,338 S 12/2001 Dalebout
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris
6,416,446 B1 * 7/2002 Krull ..... A63B 21/0628 482/107
6,422,980 B1 7/2002 Simonson
6,447,424 B1 9/2002 Ashby et al.
6,458,060 B1 10/2002 Watterson
6,458,061 B2 10/2002 Simonson
6,471,622 B1 10/2002 Hammer
6,563,225 B2 5/2003 Soga
6,601,016 B1 7/2003 Brown
6,623,140 B2 9/2003 Watterson
6,626,799 B2 9/2003 Watterson
6,652,424 B2 11/2003 Dalebout
6,685,607 B1 2/2004 Olson
6,695,581 B2 2/2004 Wasson
6,701,271 B2 3/2004 Willner
6,702,719 B1 3/2004 Brown
6,712,740 B2 3/2004 Simonson
6,730,002 B2 5/2004 Hald
6,743,153 B2 6/2004 Watterson
6,746,371 B1 6/2004 Brown
6,749,537 B1 6/2004 Hickman
6,761,667 B1 7/2004 Cutler et al.
6,770,015 B2 8/2004 Simonson
6,786,852 B2 9/2004 Watterson
6,808,472 B1 10/2004 Hickman
6,821,230 B2 11/2004 Dalebout
6,830,540 B2 12/2004 Watterson
6,863,641 B1 3/2005 Brown
6,866,613 B1 3/2005 Brown
6,875,160 B2 4/2005 Watterson
D507,311 S 7/2005 Butler
6,918,858 B2 7/2005 Watterson
6,921,351 B1 7/2005 Hickman
6,974,404 B1 12/2005 Watterson
6,997,852 B2 2/2006 Watterson
7,025,713 B2 4/2006 Dalebout
D520,085 S 5/2006 Willardson
7,044,897 B2 5/2006 Myers
7,052,442 B2 5/2006 Watterson
7,060,006 B1 6/2006 Watterson
7,060,008 B2 6/2006 Watterson et al.
7,070,539 B2 7/2006 Brown
7,097,588 B2 8/2006 Watterson
D527,776 S 9/2006 Willardson
7,112,168 B2 9/2006 Dalebout et al.
7,128,693 B2 10/2006 Brown
7,166,062 B1 1/2007 Watterson
7,166,064 B2 1/2007 Watterson
7,169,087 B2 1/2007 Ercanbrack
7,169,093 B2 1/2007 Simonson
7,192,388 B2 3/2007 Dalebout
7,250,022 B2 7/2007 Dalebout
7,282,016 B2 10/2007 Simonson
7,285,075 B2 10/2007 Cutler
7,344,481 B2 3/2008 Watterson
7,377,882 B2 5/2008 Watterson
7,425,188 B2 9/2008 Ercanbrack
7,429,236 B2 9/2008 Dalebout
7,455,622 B2 11/2008 Watterson
7,482,050 B2 1/2009 Olson
D588,655 S 3/2009 Utykanski
7,510,509 B2 3/2009 Hickman
7,537,546 B2 5/2009 Watterson
7,537,549 B2 5/2009 Nelson
7,537,552 B2 5/2009 Dalebout
7,540,828 B2 6/2009 Watterson
7,549,947 B2 6/2009 Hickman
7,556,590 B2 7/2009 Watterson et al.
7,563,203 B2 7/2009 Dalebout
7,575,536 B1 8/2009 Hickman
7,601,105 B1 10/2009 Gipson, III
7,604,573 B2 10/2009 Dalebout
D604,373 S 11/2009 Dalebout
7,618,350 B2 11/2009 Dalebout
7,618,357 B2 11/2009 Dalebout
7,625,315 B2 12/2009 Hickman
7,625,321 B2 12/2009 Simonson
7,628,730 B1 12/2009 Watterson
7,628,737 B2 12/2009 Kowallis
7,637,847 B1 12/2009 Hickman
7,645,212 B2 1/2010 Ashby et al.
7,645,213 B2 1/2010 Watterson
7,658,698 B2 2/2010 Pacheco
7,674,205 B2 3/2010 Dalebout
7,713,171 B1 5/2010 Hickman
7,713,172 B2 5/2010 Watterson
7,713,180 B2 5/2010 Wickens
7,717,828 B2 5/2010 Simonson
7,736,279 B2 6/2010 Dalebout
7,740,563 B2 6/2010 Dalebout
7,749,144 B2 7/2010 Hammer
7,766,797 B2 8/2010 Dalebout
7,771,329 B2 8/2010 Dalebout
7,775,940 B2 8/2010 Dalebout
7,789,800 B1 9/2010 Watterson
7,798,946 B2 9/2010 Dalebout
7,815,550 B2 10/2010 Watterson
7,857,731 B2 12/2010 Hickman
7,862,475 B2 1/2011 Watterson
7,862,478 B2 1/2011 Watterson
7,862,483 B2 1/2011 Hendrickson
D635,207 S 3/2011 Dalebout
7,901,330 B2 3/2011 Dalebout
7,909,740 B2 3/2011 Dalebout
7,980,996 B2 7/2011 Hickman
7,981,000 B2 7/2011 Watterson
7,985,164 B2 7/2011 Ashby
8,029,415 B2 10/2011 Ashby et al.
8,033,960 B1 10/2011 Dalebout
D650,451 S 12/2011 Olson
D652,877 S 1/2012 Dalebout
8,152,702 B2 4/2012 Pacheco
D659,775 S 5/2012 Olson
D659,777 S 5/2012 Watterson
D660,383 S 5/2012 Watterson
D664,613 S 7/2012 Dalebout
8,251,874 B2 8/2012 Ashby
8,298,123 B2 10/2012 Hickman
8,298,125 B2 10/2012 Colledge

(56) References Cited

U.S. PATENT DOCUMENTS

D671,177 S 11/2012 Sip
D671,178 S 11/2012 Sip
D673,626 S 1/2013 Olson
8,690,735 B2 4/2014 Watterson
D707,763 S 6/2014 Cutler
8,740,753 B2 6/2014 Olson
8,758,201 B2 6/2014 Ashby
8,771,153 B2 7/2014 Dalebout
8,784,270 B2 7/2014 Watterson
8,808,148 B2 8/2014 Watterson
8,814,762 B2 8/2014 Butler
D712,493 S 9/2014 Ercanbrack
8,840,075 B2 9/2014 Olson
8,845,493 B2 9/2014 Watterson
8,870,726 B2 10/2014 Watterson
8,876,668 B2 11/2014 Hendrickson
8,894,549 B2 11/2014 Colledge
8,894,555 B2 11/2014 Olson
8,911,330 B2 12/2014 Watterson
8,920,288 B2 12/2014 Dalebout
8,986,165 B2 3/2015 Ashby
8,992,364 B2 3/2015 Law
8,992,387 B2 3/2015 Watterson
D726,476 S 4/2015 Ercanbrack
9,022,907 B2 * 5/2015 Wang ..... A63B 21/0728 482/108
9,028,368 B2 5/2015 Ashby
9,028,370 B2 5/2015 Watterson
9,039,578 B2 5/2015 Dalebout
D731,011 S 6/2015 Buchanan
9,072,930 B2 7/2015 Ashby
9,119,983 B2 9/2015 Rhea
9,123,317 B2 9/2015 Watterson
9,126,071 B2 9/2015 Smith
9,126,072 B2 * 9/2015 Watterson ..... A63B 21/0726
9,138,615 B2 9/2015 Olson
9,142,139 B2 9/2015 Watterson
9,144,703 B2 9/2015 Dalebout
9,149,683 B2 9/2015 Smith
9,186,535 B2 11/2015 Ercanbrack
9,186,549 B2 11/2015 Watterson
9,254,409 B2 2/2016 Dalebout
9,254,416 B2 2/2016 Ashby
9,278,248 B2 3/2016 Tyger
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson
9,352,186 B2 5/2016 Watterson
9,375,605 B2 6/2016 Tyger
9,381,394 B2 7/2016 Mortensen
9,387,387 B2 7/2016 Dalebout
9,393,453 B2 7/2016 Watterson
9,403,047 B2 8/2016 Olson
9,403,051 B2 8/2016 Cutler
9,421,416 B2 8/2016 Mortensen
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen
9,498,668 B2 11/2016 Smith
9,517,378 B2 12/2016 Ashby
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout
9,586,090 B2 3/2017 Watterson
9,604,099 B2 3/2017 Taylor
9,616,276 B2 4/2017 Dalebout
9,616,278 B2 4/2017 Olson
9,623,281 B2 4/2017 Hendrickson
9,636,567 B2 5/2017 Brammer
9,675,839 B2 6/2017 Dalebout
9,682,307 B2 6/2017 Dalebout
9,694,234 B2 7/2017 Dalebout
9,694,242 B2 7/2017 Ashby
9,737,755 B2 8/2017 Dalebout
9,757,605 B2 9/2017 Olson
9,764,186 B2 9/2017 Dalebout
9,767,785 B2 9/2017 Ashby
9,795,822 B2 * 10/2017 Smith ..... A63B 24/0087
9,808,672 B2 11/2017 Dalebout
9,849,326 B2 12/2017 Smith
9,878,210 B2 1/2018 Watterson
9,889,334 B2 2/2018 Ashby
9,889,339 B2 2/2018 Douglass
9,937,376 B2 4/2018 McInelly
9,937,377 B2 4/2018 McInelly
9,937,378 B2 4/2018 Dalebout
9,937,379 B2 4/2018 Mortensen
9,943,719 B2 * 4/2018 Smith ..... A63B 24/0087
9,943,722 B2 4/2018 Dalebout
9,948,037 B2 4/2018 Ashby
9,956,451 B1 * 5/2018 Wang ..... A63B 21/4043
9,968,816 B2 5/2018 Olson
9,968,821 B2 5/2018 Finlayson
9,968,823 B2 5/2018 Cutler
10,010,755 B2 7/2018 Watterson
10,010,756 B2 7/2018 Watterson
10,022,583 B2 * 7/2018 Wang ..... A63B 21/0726
10,029,145 B2 7/2018 Douglass
D826,350 S 8/2018 Hochstrasser
10,046,196 B2 8/2018 Ercanbrack
D827,733 S 9/2018 Hochstrasser
10,065,064 B2 * 9/2018 Smith ..... G08C 17/00
10,071,285 B2 * 9/2018 Smith ..... A63B 24/0087
10,085,586 B2 10/2018 Smith
10,086,254 B2 10/2018 Watterson
10,136,842 B2 11/2018 Ashby
10,186,161 B2 1/2019 Watterson
10,188,890 B2 1/2019 Olson
10,207,143 B2 2/2019 Dalebout
10,207,145 B2 2/2019 Tyger
10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,664 B2 3/2019 Dalebout
10,252,109 B2 4/2019 Watterson
10,258,828 B2 4/2019 Dalebout
10,272,317 B2 4/2019 Watterson
10,279,212 B2 5/2019 Dalebout
10,293,211 B2 5/2019 Watterson
D852,292 S 6/2019 Cutler
10,343,017 B2 7/2019 Jackson
10,376,736 B2 8/2019 Powell
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby
10,441,840 B2 10/2019 Dalebout
10,449,416 B2 10/2019 Dalebout
D868,909 S 12/2019 Cutler
10,492,519 B2 12/2019 Capell
10,493,349 B2 12/2019 Watterson
10,500,473 B2 12/2019 Watterson
10,543,395 B2 1/2020 Powell et al.
10,561,877 B2 2/2020 Workman
10,561,893 B2 2/2020 Chatterton
10,561,894 B2 2/2020 Dalebout
10,569,121 B2 2/2020 Watterson
10,569,123 B2 2/2020 Hochstrasser
11,040,236 B1 * 6/2021 Chen ..... A63B 21/0728
11,065,499 B2 * 7/2021 Chen ..... A63B 21/0728

(56) References Cited

U.S. PATENT DOCUMENTS 11,191,993 B1* 12/2021 Chen ..... A63B 21/075
2002/0016235 A1 2/2002 Ashby
2002/0077221 A1 6/2002 Dalebout
2002/0115539 A1* 8/2002 Krull ..... A63B 21/0728 482/106
2002/0159253 A1 10/2002 Dalebout
2003/0045406 A1 3/2003 Stone
2003/0199369 A1* 10/2003 Krull ..... A63B 21/072 482/107
2004/0091307 A1 5/2004 James
2004/0171464 A1 9/2004 Ashby
2004/0171465 A1 9/2004 Hald
2005/0049123 A1 3/2005 Dalebout
2005/0077805 A1 4/2005 Dalebout
2005/0107229 A1 5/2005 Wickens
2005/0164839 A1 7/2005 Watterson
2005/0272577 A1 12/2005 Olson
2005/0277525 A1* 12/2005 Liu ..... A63B 21/075 482/107
2006/0240958 A1* 10/2006 Liu ..... A63B 21/0728 482/107
2007/0117683 A1 5/2007 Ercanbrack
2007/0161474 A1* 7/2007 Lippitt ..... A63B 21/0728 482/106
2007/0254778 A1 11/2007 Ashby
2008/0051256 A1 2/2008 Ashby
2008/0242520 A1 10/2008 Hubbard
2008/0300110 A1 12/2008 Smith
2009/0105052 A1 4/2009 Dalebout
2009/0186748 A1* 7/2009 Golesh ..... A63B 21/0728 482/107
2010/0184570 A1* 7/2010 Cheng ..... A63B 21/0728 482/94
2010/0242246 A1 9/2010 Dalebout
2012/0115689 A1* 5/2012 Dalebout ..... A63B 21/0728 482/107
2012/0237911 A1 9/2012 Watterson
2012/0295774 A1 11/2012 Dalebout
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson
2013/0196822 A1 8/2013 Watterson
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson
2013/0281241 A1 10/2013 Watterson
2014/0024499 A1 1/2014 Watterson
2014/0073970 A1 3/2014 Ashby
2014/0121071 A1 5/2014 Strom
2014/0135173 A1 5/2014 Watterson
2014/0274574 A1 9/2014 Shorten
2014/0274579 A1 9/2014 Olson
2014/0274596 A1* 9/2014 Krull ..... A63B 21/0724 482/107
2014/0287884 A1 9/2014 Buchanan
2014/0309085 A1 10/2014 Watterson
2014/0349820 A1* 11/2014 Wang ..... A63B 21/063 482/108
2015/0182779 A1 7/2015 Dalebout
2015/0182781 A1 7/2015 Watterson
2015/0238817 A1 8/2015 Watterson
2015/0250418 A1 9/2015 Ashby
2015/0251055 A1 9/2015 Ashby
2015/0253735 A1 9/2015 Watterson
2015/0253736 A1 9/2015 Watterson
2015/0258560 A1 9/2015 Ashby
2015/0360073 A1* 12/2015 Moran ..... A63B 21/0726 482/107
2016/0058335 A1 3/2016 Ashby
2016/0059064 A1* 3/2016 Smith ..... A63B 21/0728 482/5
2016/0063615 A1 3/2016 Watterson
2016/0089559 A1* 3/2016 Smith ..... A63B 21/00065 482/5
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0166873 A1* 6/2016 Liu ..... A63B 21/0726 482/107
2016/0184623 A1* 6/2016 Moran ..... A63B 21/075 482/8
2016/0346595 A1 12/2016 Dalebout
2017/0001061 A1* 1/2017 Marjama ..... A63B 71/0036
2017/0036053 A1 2/2017 Smith
2017/0056711 A1 3/2017 Dalebout
2017/0056715 A1 3/2017 Dalebout
2017/0124912 A1 5/2017 Ashby
2017/0193578 A1 7/2017 Watterson
2017/0239510 A1* 8/2017 Wang ..... A63B 21/0724
2017/0252599 A1* 9/2017 Wang ..... A63B 21/0726
2017/0266489 A1 9/2017 Douglass
2017/0266533 A1 9/2017 Dalebout
2017/0270820 A1 9/2017 Ashby
2018/0001135 A1 1/2018 Powell
2018/0036585 A1 2/2018 Powell
2018/0078810 A1* 3/2018 Chen ..... A63B 71/0036
2018/0078811 A1* 3/2018 Chen ..... A63B 21/0726
2018/0085630 A1 3/2018 Capell
2018/0089396 A1 3/2018 Capell
2018/0099116 A1 4/2018 Ashby
2018/0099180 A1 4/2018 Wilkinson
2018/0111034 A1 4/2018 Watterson
2018/0117385 A1 5/2018 Watterson
2018/0117393 A1 5/2018 Ercanbrack
2018/0154209 A1 6/2018 Watterson
2018/0200566 A1 7/2018 Weston
2018/0353794 A1* 12/2018 Wang ..... A63B 71/0036
2019/0058370 A1 2/2019 Tinney
2019/0080624 A1 3/2019 Watterson
2019/0151698 A1 5/2019 Olson
2019/0168072 A1 6/2019 Brammer
2019/0178313 A1 6/2019 Wrobel
2019/0192898 A1 6/2019 Dalebout
2019/0192952 A1 6/2019 Powell
2019/0209893 A1 7/2019 Watterson
2019/0223612 A1 7/2019 Watterson
2019/0232112 A1 8/2019 Dalebout
2019/0269958 A1 9/2019 Dalebout
2019/0269971 A1 9/2019 Capell
2019/0275366 A1 9/2019 Powell
2019/0282852 A1 9/2019 Dalebout
2019/0328079 A1 10/2019 Ashby
2019/0329091 A1 10/2019 Powell
2019/0376585 A1 12/2019 Buchanan
2019/0388723 A1* 12/2019 Nalley ..... A63B 21/4035
2020/0009417 A1 1/2020 Dalebout
2020/0016459 A1 1/2020 Smith
2020/0238130 A1 7/2020 Silcock
2020/0254295 A1 8/2020 Watterson
2020/0254309 A1 8/2020 Watterson
2020/0254311 A1 8/2020 Watterson
2020/0398100 A1* 12/2020 Wang ..... A63B 21/0726
2021/0146186 A1* 5/2021 Chen ..... A63B 21/075
2021/0154519 A1* 5/2021 Chen ..... A63B 21/078

(56) References Cited

U.S. PATENT DOCUMENTS

| | | | | |
|---|---|---|---|---|
| 2021/0322817 | A1* | 10/2021 | Chen | A63B 21/0728 |
| 2022/0047908 | A1* | 2/2022 | Weng | A63B 21/0726 |

OTHER PUBLICATIONS

U.S. Appl. No. 13/088,007, filed Apr. 15, 2011, Scott R. Watterson.
U.S. Appl. No. 15/973,176, filed May 7, 2018, Melanie Douglass.
U.S. Appl. No. 16/879,376, filed May 20, 2020, David Hays.
U.S. Appl. No. 16/992,870, filed Aug. 13, 2020 Gaylen Ercanbrack.
U.S. Appl. No. 16/992,886, filed Aug. 13, 2020, William T. Dalebout.
U.S. Appl. No. 62/897,113, filed Sep. 9, 2019, Megan Jane Ostler.
U.S. Appl. No. 62/934,291, filed Nov. 12, 2019, William T. Dalebout.
U.S. Appl. No. 62/934,297, filed Nov. 12, 2019, William T. Dalebout.
U.S. Appl. No. 62/991,378, filed Mar. 18, 2020, Chris Nascimento.
U.S. Appl. No. 62/994,204, filed Mar. 24, 2020, Chase Brammer.
U.S. Appl. No. 63/073,081, filed Sep. 1, 2020, Darren C. Ashby.
U.S. Appl. No. 63/079,697, filed Sep. 17, 2020, Jared Willardson.
U.S. Appl. No. 63/086,793, filed Oct. 2, 2020, Darren C. Ashby.

* cited by examiner

ADJUSTABLE DUMBBELL SYSTEM

CROSS-REFERENCE TO RELATED APPLICATIONS

This application claims priority to provisional patent application No. 62/887,391 entitled "ADJUSTABLE DUMBBELL SYSTEM" filed Aug. 15, 2019, which application is herein incorporated by reference for all that it discloses.

BACKGROUND

Background and Relevant Art

Muscle training may involve a user moving weights, often called dumbbells, in specific motions to tone body muscles. Different muscle groups may be exercised with different amounts of weight. Indeed, the same muscle group may be exercised with different amounts of weights. Fixed dumbbells have a fixed weight. A collection of fixed dumbbells may be expensive, and may require a large amount of storage space. Adjustable dumbbells allow a user to add or remove weight plates from a handle to customize the weight of the dumbbell. This may save the user money, by requiring a smaller amount of weights to be purchased, and may save the user space by requiring a smaller storage space.

BRIEF SUMMARY

In some embodiments, a system for securing an adjustable dumbbell includes a handle. A plate adjustment mechanism is configured to selectively connect a selected weight plate of a plurality of weight plates to the handle. Each weight plate includes a notch. A cradle is configured to receive the plurality of weight plates, the cradle includes a latch. A retention mechanism is configured to selectively engage the latch with the notch of an unselected weight plate. The handle adjustment mechanism is mechanically connected to the cradle adjustment mechanism In other embodiments, a system for securing an adjustable dumbbell includes a handle. A plurality of weight plates are removably connected to the handle. Each weight plate includes a notch. A cradle includes a plurality of weight plate receptacles. Each weight plate receptacle is configured to receive each weight plate of the plurality of weight plates. A plurality of latches are configured to be selectively inserted into the notch. The plurality of latches are individually actuated.

In yet other embodiments, a method for securing an adjustable dumbbell includes placing a dumbbell handle in a cradle. The dumbbell handle is selectively connected to a selected weight plate of a plurality of weight plates. An unselected weight plate is secured to the cradle based on the selected weight plate.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 2 is a top down view of an adjustable dumbbell system, according to at least one embodiment of the present disclosure;

FIG. 3 is a representation of a cradle, according to at least one embodiment of the present disclosure;

FIG. 4 is a representation of a weight plate, according to at least one embodiment of the present disclosure;

FIG. 5-1 is a representation of an adjustable dumbbell system, according to at least one embodiment of the present disclosure;

FIG. 5-2 is a perspective view of a retention mechanism, according to at least one embodiment of the present disclosure;

FIG. 11-1 through FIG. 11-4 are representations of an adjustable dumbbell assembly, according to at least one embodiment of the present disclosure.

DETAILED DESCRIPTION

Adjustable dumbbells allow a user to exercise using a selected weight within a weight range, while reducing the need for individual dumbbells of a series of weights within the same weight range. Adjustable dumbbells include a handle or other support bar which may then have one or more weight plates selectively connected to the support bar. To increase the weight of the adjustable dumbbell, the user simply connects or attaches additional weight plates to the handle until the desired weight is reached. In some embodiments, the adjustable dumbbell may be a hand weight. An example of an adjustable dumbbell is shown in U.S. Pat. No. 9,795,822, the entirety of which is herein incorporated by reference. For example, the handle may be sized such that a spacing between two sets of weight plates is wide enough for a single hand. In some embodiments, the adjustable dumbbell may be a long bar, such as a bar used for squats, bench press, and so forth. The long bar may have a width between sets of weight plates sufficient for widely spaced hands (e.g., greater than shoulder length apart). In some embodiments, the adjustable dumbbell may be a weight for a weight machine. In some embodiments, the adjustable dumbbell may have a single set of weight plates, such as for a kettle ball.

In some embodiments, an adjustable dumbbell may include a plate adjustment mechanism that connects selected weight plates to the adjustable dumbbell until the desired weight is reached. Regardless of how the selected weight plates are connected to the handle, a user may not always have all the weight plates simultaneously connected to the handle. Therefore, when the user removes the handle from the cradle, one or more unselected weight plates may remain behind in the cradle. These unselected weight plates may become dislodged from the cradle. In at least one embodiment, an unselected weight plate that is dislodged from the cradle may become a safety hazard, and may be dropped on a user, left on the floor to be tripped over, or present another safety hazard. Furthermore, in at least one embodiment, the unselected weight plate that is dislodged from the cradle may become misplaced. For example, the unselected weight plate may be stolen, lost, put away in the wrong plate, or otherwise misplaced.

To prevent the unselected weight plates from becoming dislodged from the cradle, the cradle may include a retention mechanism. The retention mechanism may secure the unselected weight plates to the cradle while allowing the selected weight plates to be removed from the cradle while attached to the handle. In this manner, the unselected weight plates may not become dislodged, and therefore may not be a safety hazard or misplaced. Securing the unselected weight plates to the cradle may further improve the exercise experience for the user by removing the need for the user to consciously keep track of the unselected weight plates.

Figure 1:
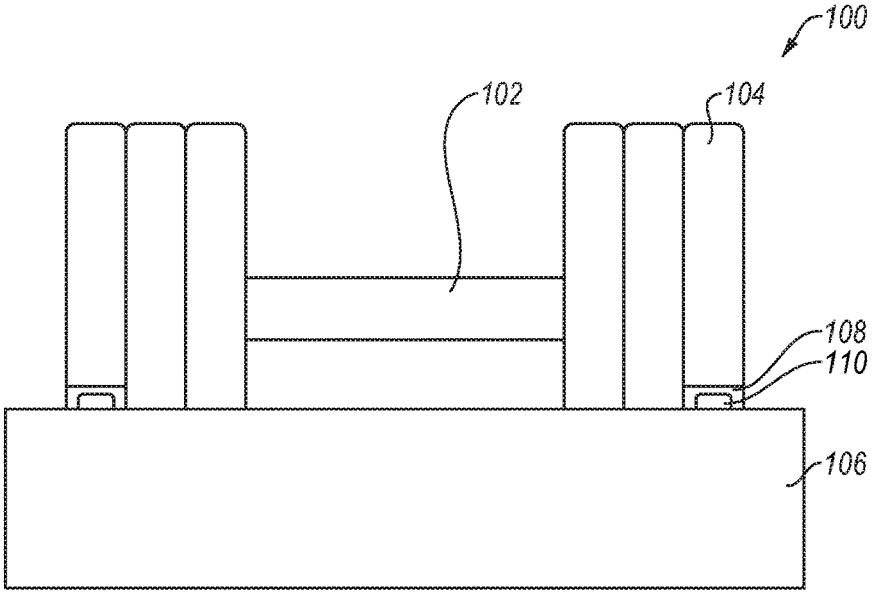
FIG. 1-1 through 1-5 are side views of an adjustable dumbbell system, according to at least one embodiment of the present disclosure.

FIG. 1-1 is a side-view representation of an adjustable dumbbell system 100, according to at least one embodiment of the present disclosure. The adjustable dumbbell system 100 includes a handle 102 and a plurality of weight plates 104. The weight plates 104 may be selectively secured to the handle 102. The weight plates 104 and the handle 102 are placed in a cradle 106. The weight plates 104 include a notch 108. A latch 110 inserted into the notch 108 may selectively secure the weight plates 104 to the cradle 106. In this manner, when the handle 102 is removed, the weight plates that are secured to the cradle 106 may remain in the cradle 106, and the weight plates connected to the handle 102 may become removed from the handle 102 with the cradle.

Figures 1, 2:
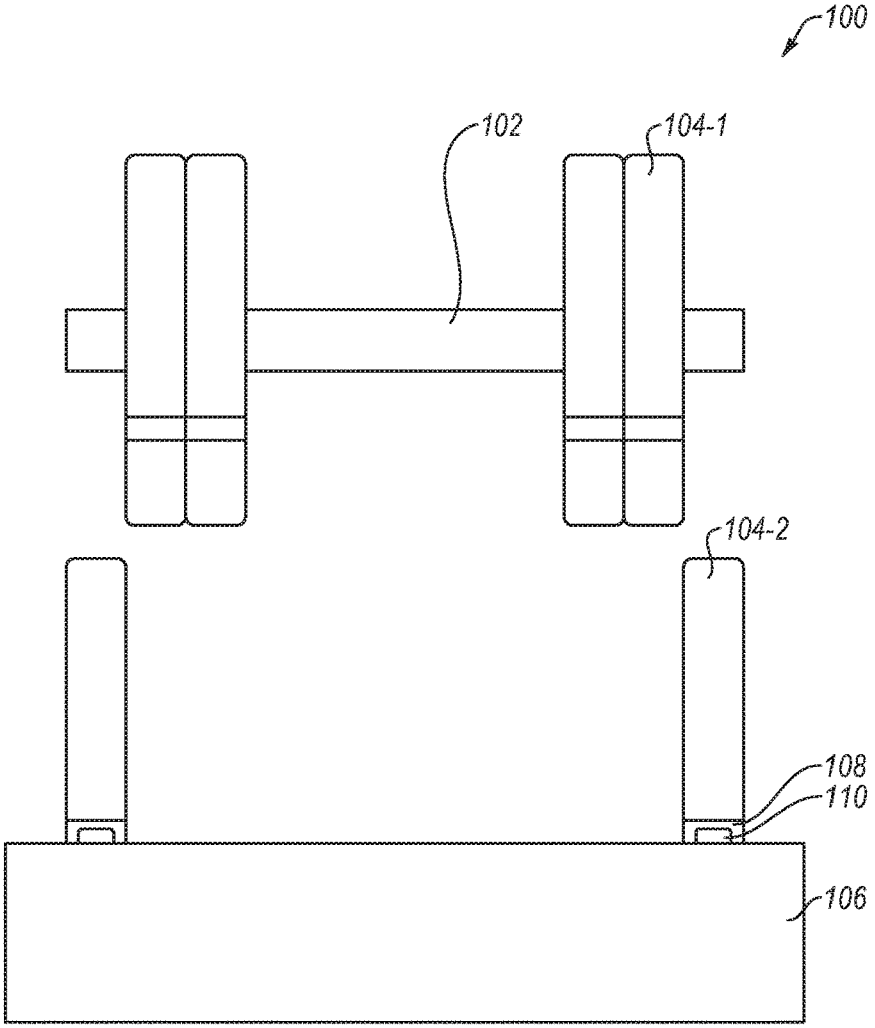

FIG. 1-2 is a representation of the adjustable dumbbell system 100 of FIG. 1-1 with the handle 102 removed from the cradle 106. In the position shown, a plurality of selected weight plates 104-1 are attached or connected to the handle 102. Thus, when the handle 102 is removed from the cradle 106, the selected weight plates 104-1 are removed from the cradle 106 with the handle 102. Thus, by selecting the selected weight plates 104-1, the user may customize the amount of weight attached to the handle 102.

The unselected weight plates 104-2 remain in the cradle 106 when the handle 102 and the selected weight plates 104-1 are removed from the cradle 106. The unselected weight plates 104-2 are secured to the cradle 106 with a latch 110 inserted into a notch 108. By securing the unselected weight plates 104-2 to the cradle 106, the unselected weight plates 104-2 may not become dislodged from the cradle, and may therefore have a reduced chance of becoming misplaced or a safety hazard.

As may be seen, only the unselected weight plates 104-2 are secured to the cradle 106. Furthermore, the unselected weight plates 104-2 are secured to the cradle 106 before the handle 102 is removed with the selected weight plates 104-1. Thus, the unselected weight plates 104-2 are individually and selectively secured to the cradle 106, and the unselected weight plates 104-2 are individually and selectively not secured to the cradle 106.

FIG. 1-3 and FIG. 1-4 are further side-views of the adjustable dumbbell system 100 of FIG. 1-1. In the embodiment shown, the outer-most weight plate 104-2 is an unselected weight plate 104-2, and the handle 102 is placed in the cradle 106. The latch 110 is inserted into the notch 108 of the unselected weight plate 104-2. In FIG. 1-4, the handle 102 and the connected selected weight plates 104-1 have been removed from the cradle 106. The unselected weight plates 104-2 remain secured to the cradle 106.

FIG. 1-5 is a top-down view of the of the adjustable dumbbell system 100 of FIG. 1-1. In the embodiment shown, the cradle 106 includes a plurality of latches 110. Indeed, the cradle 106 includes a latch 110 for each weight plate (collectively 104). In the embodiment shown, each weight plate 104 includes a latch 110 on either side of the weight plate 104. Including a latch 110 on either side of the weight plate 104 may provide a stronger connection between the weight plate 104 and the cradle 106.

The cradle 106 includes a weight selection input 112. To operate the adjustable dumbbell system 100, the user simply inputs the desired weight into the weight selection input, and a plate adjustment mechanism (not shown) connects the selected weight plates 104-1 to the handle 102 and a retention mechanism secures the unselected weight plate 104-2 to the cradle 106.

As discussed above, each weight plate 104 may be secured to the cradle 106 individually before the handle 102 is removed from the cradle 106. Thus, each latch of the plurality of latches 110 is individually actuated. In this manner, the unselected weight plates 104-2 may be secured to the cradle 106 even if the selected weight plates 104-1 bump and jostle the unselected weight plates 104-2 while being removed.

FIG. 2 is a representation of an adjustable dumbbell system 200, according to at least one embodiment of the present disclosure. In the embodiment shown, the cradle includes a plurality of first latches 210-1 and a second latch 210-2. The plurality of first latches 210-1 may individually actuate to secure one or more of the weight plates 204 to the cradle 206. The second latch 210-2 may actuate to secure all of the weight plates 204 to the cradle 206. This may allow a user to input into the weight selection input 212 the selected weight, and remove the handle 202 and the selected weights. When done using the adjustable dumbbell system 200, the user may input a weight of 0, or indicate a locking input, and the second latch 210-2 engages with each weight plate 204 to secure all of the weight plates 204 to the cradle. This may increase the stability and/or security of the adjustable dumbbell system 200 while not in use or during transport. Furthermore, this may help to prevent some or all of the adjustable dumbbell system 200 from becoming a safety hazard.

Figures 1, 2, 3:
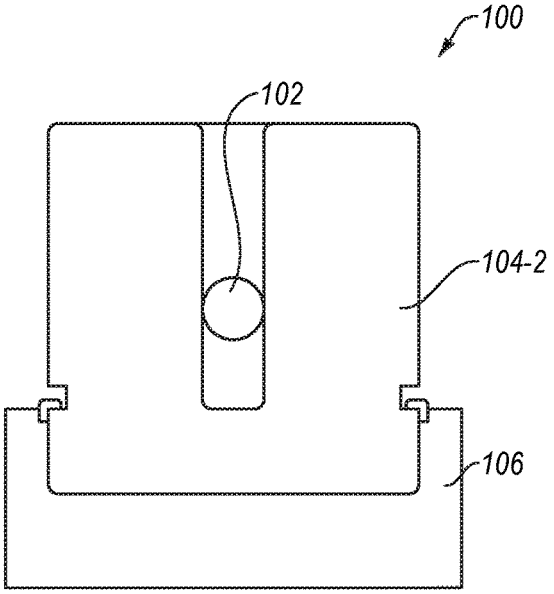

FIG. 3 is a representation of an embodiment of a cradle 306, according to at least one embodiment of the present disclosure. The cradle 306 includes a plurality of weight plate receptacles 314. Each weight plate receptacle is configured to receive a weight plate (e.g., weight plate 104 of FIG. 1-1). The weight plate receptacle shown is an indentation in the cradle 306, which aligns and helps to orient the weight plates with respect to the cradle 306. A latch (collectively 310) is shown in or at the edge of each weight plate receptacle 314. The latch 310 is configured to secure a weight plate to the cradle 306 in the weight plate receptacle 314.

In the embodiment shown, a first plurality of latches 310-1 is located on a first side of the weight plate receptacles 314, and a second plurality of latches 310-2 is located on a second side of the weight plate receptacles 314. Including latches 310 on either side of the weight plate receptacles 314 may allow for a simplified retention mechanism, or allow for the retention mechanisms to have increased control over which weight plates are selected and unselected.

Figures 1, 2, 3, 4:
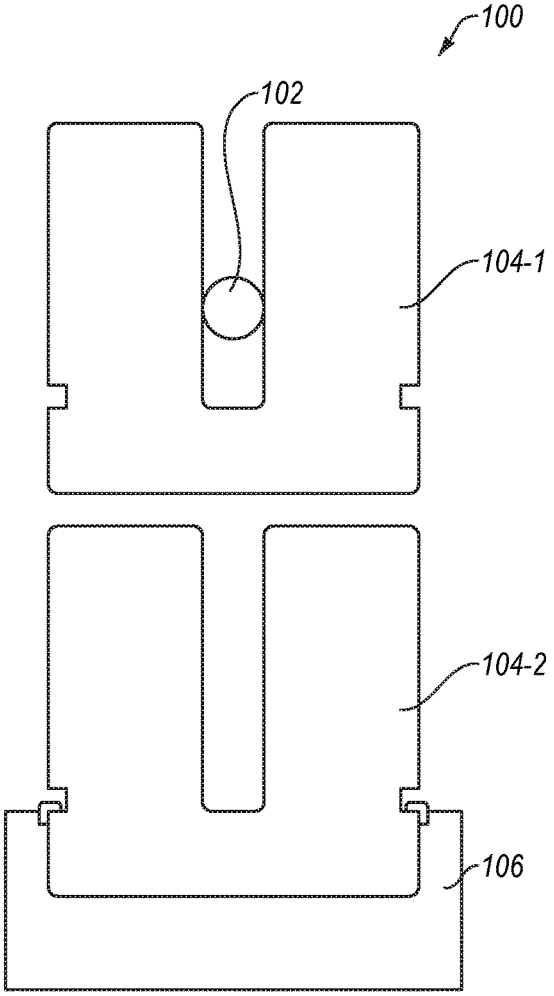

FIG. 4 is a cut-away view of a weight plate 404 and a retention mechanism 416, according to at least one embodiment of the present disclosure. The weight plate 404 includes a handle space 418 in a top surface 420 into which a handle (e.g., the handle 102 of FIG. 1-1) may be inserted. The weight plate 404 further includes a notch 408 in a lateral face (collectively 422). In the embodiment shown, the weight plate 404 includes a notch 408 in both a first lateral face 422-1 and a second lateral face 422-2.

The notch 408 includes a notch engagement angle 424, which is the angle measured clockwise between a notch engagement surface 426 and the second lateral face 422. In some embodiments, the notch engagement angle 424 may be in a range having an upper value, a lower value, or upper and lower values including any of 45°, 60°, 75°, 80°, 85°, 90°, 95°, 100°, 105°, 120°, 135°, or any value therebetween. For example, the notch engagement angle 424 may be greater than 45°. In another example, the notch engagement angle 424 may be less than 135°. In yet other examples, the notch engagement angle 424 may be any value in a range between 45° and 135°. A notch engagement angle 424 that is close to 90° may provide the greatest force to secure the weight plate to the cradle. In some embodiments, a notch engagement angle 424 of less than 135° may be critical to provide sufficient force to secure the weight plate to the cradle.

A latch 410 includes a protrusion 428 that extends into the notch 408. In the embodiment shown, the protrusion 428 has a triangular cross-sectional shape. The protrusion 428 has a latch engagement surface 430 that engages with the notch engagement surface 426. In the embodiment shown, the notch engagement surface 430 has the same shape as the latch engagement surface. In this manner, the bearing surface between the latch engagement surface 430 and the notch engagement surface 426 is maximized. Because protrusion 428 is inserted into the notch 408, the protrusion 428 contacts the notch at the notch engagement surface 426 when a removal force is applied to the weight plate 404. The interference between the notch 408 and the protrusion 428 secures the weight plate 404 to the cradle.

The protrusion includes a latch engagement angle 432, which is the angle measured clockwise between the latch engagement surface 430 and a line 433 parallel to the first lateral face 422-1. In some embodiments, the latch engagement angle 432 may be in a range having an upper value, a lower value, or upper and lower values including any of 45°, 60°, 75°, 80°, 85°, 90°, 95°, 100°, 105°, 120°, 135°, or any value therebetween. For example, the latch engagement angle 432 may be greater than 45°. In another example, the latch engagement angle 432 may be less than 135°. In yet other examples, the latch engagement angle 432 may be any value in a range between 45° and 135°. A latch engagement angle 432 that is close to 90° may provide the greatest force to secure the weight plate to the cradle. In some embodiments, a latch engagement angle 432 of between 75° and 105° may be critical to provide sufficient force to secure the weight plate to the cradle.

In some embodiments, the latch engagement angle 432 and the notch engagement angle 424 are supplementary. In other words, the latch engagement angle 432 and the notch engagement angle 424 add up to 180°. Supplementary latch engagement angles 432 and notch engagement angles 424 may increase the bearing surface between the latch engagement surface and the notch engagement surface. This may increase the force with which the weight plate is secured to the cradle. In some embodiments, the latch engagement angle 432 and the notch engagement angle 424 are not supplementary, and may add up to an angle that is greater than or less than 180°.

The latch 410 includes a latch arm 434 that extends from the protrusion 428. In the embodiment shown, the latch arm 434 rotates about a pivot 436. The retention mechanism 416 includes a latch cam shaft 438 including a lobe 439. As the latch cam shaft 438 rotates, the lobe 439 pushes on a lower portion 440 of the latch arm 434. When the lobe 439 pushes on the lower portion 440, the latch arm 434 rotates about the pivot 436, and an upper portion 442 of the latch arm 434 rotates (counterclockwise in the view shown) toward the notch 408. This may insert the protrusion 428 into the notch 408. As the latch cam shaft 438 rotates further, the lob rotates away from the lower portion 440, and a resilient member (not shown) may urge the arm latch 434 to rotate (clockwise in the view shown) about the pivot 436. This may cause the upper portion 442 and the protrusion 428 move away from the notch 408, thereby un-securing the weight plate 404 from the cradle, and allowing the weight plate 404 to be removed.

Figures 1, 2, 3, 4, 5:
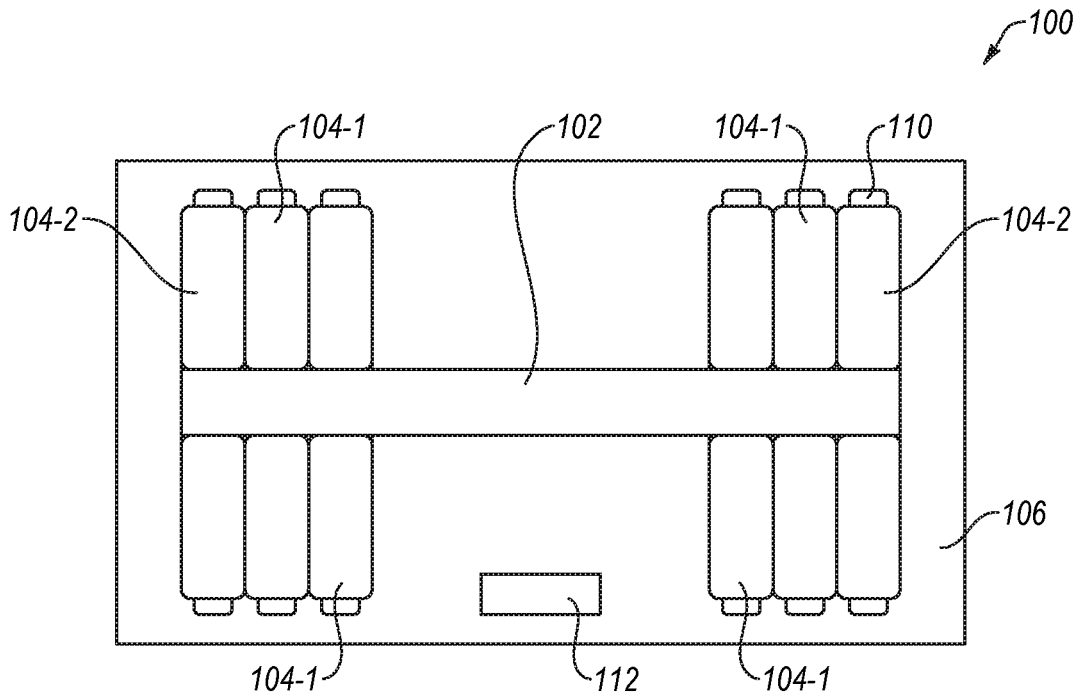
Figure 2:
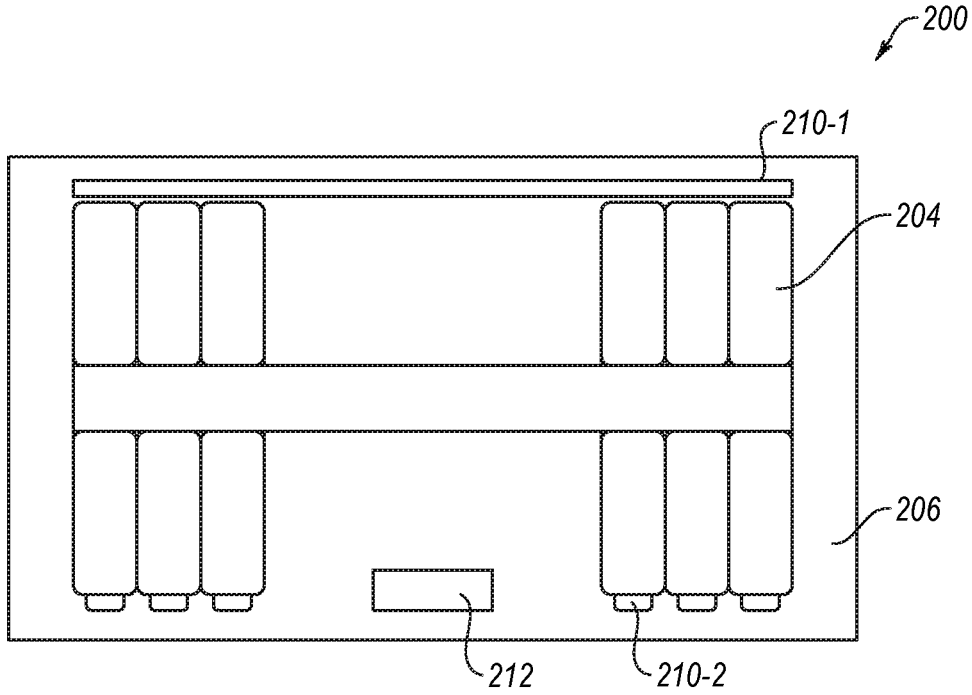
Figure 3:
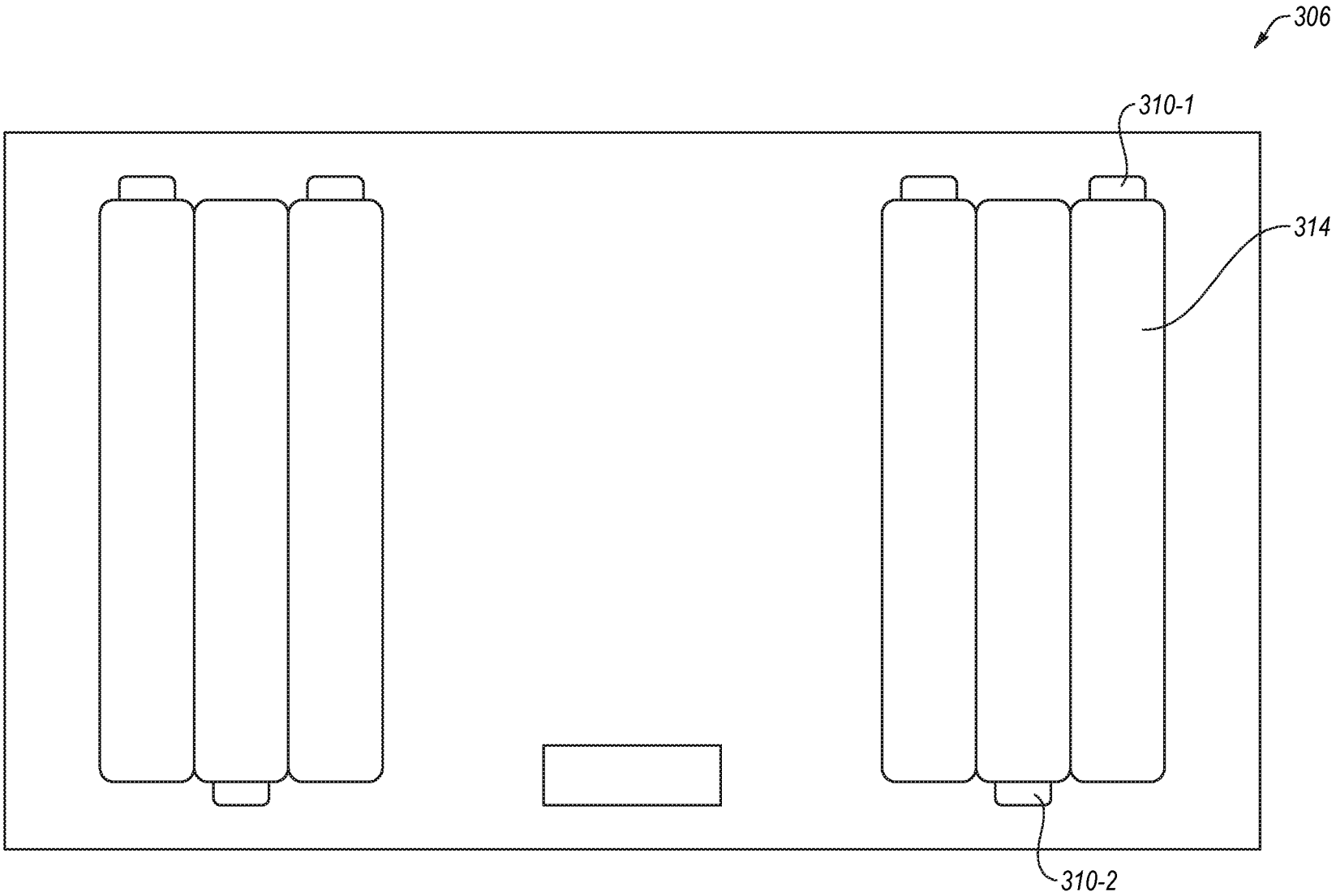
Figure 4:
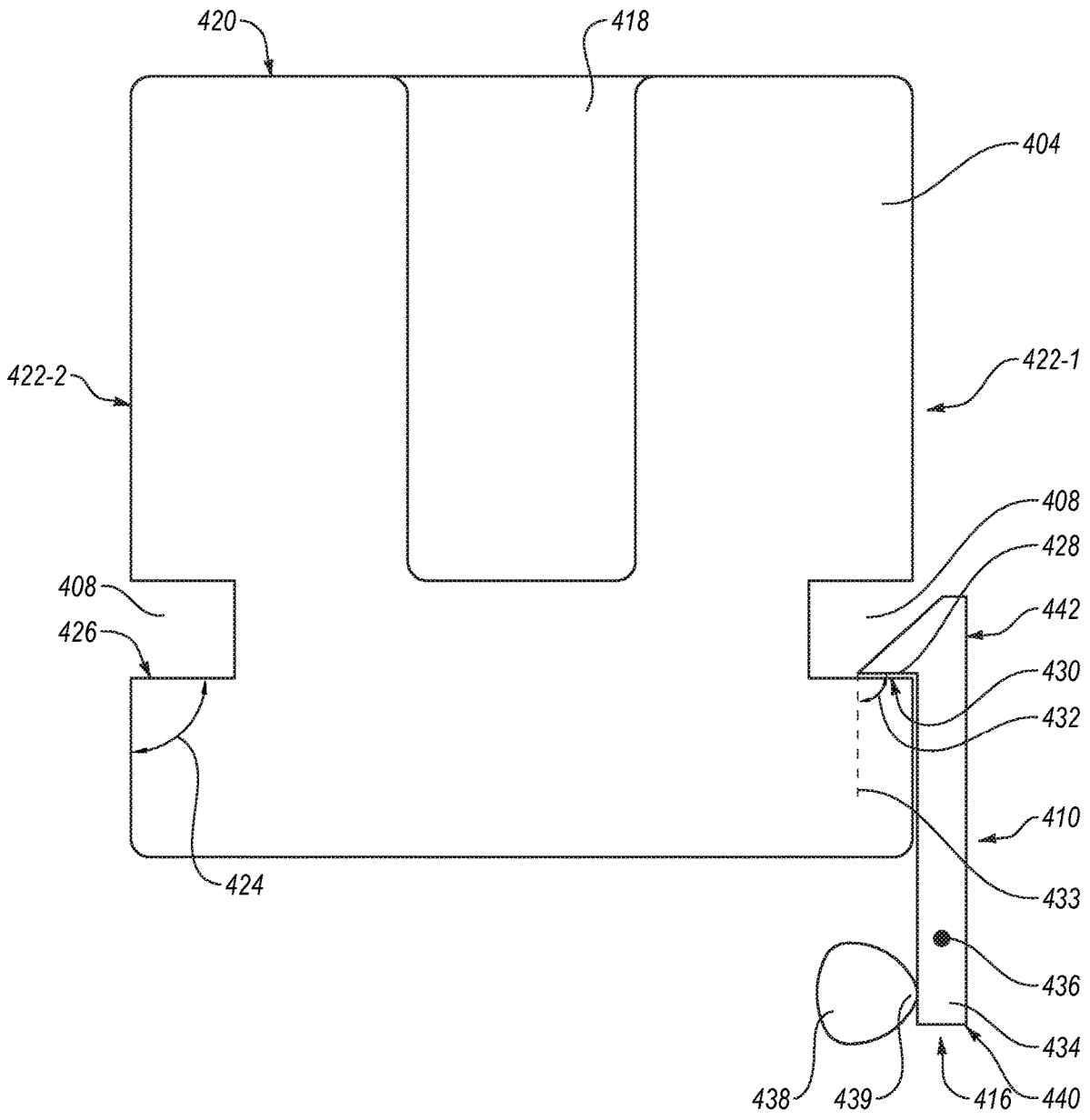
Figures 1, 5:
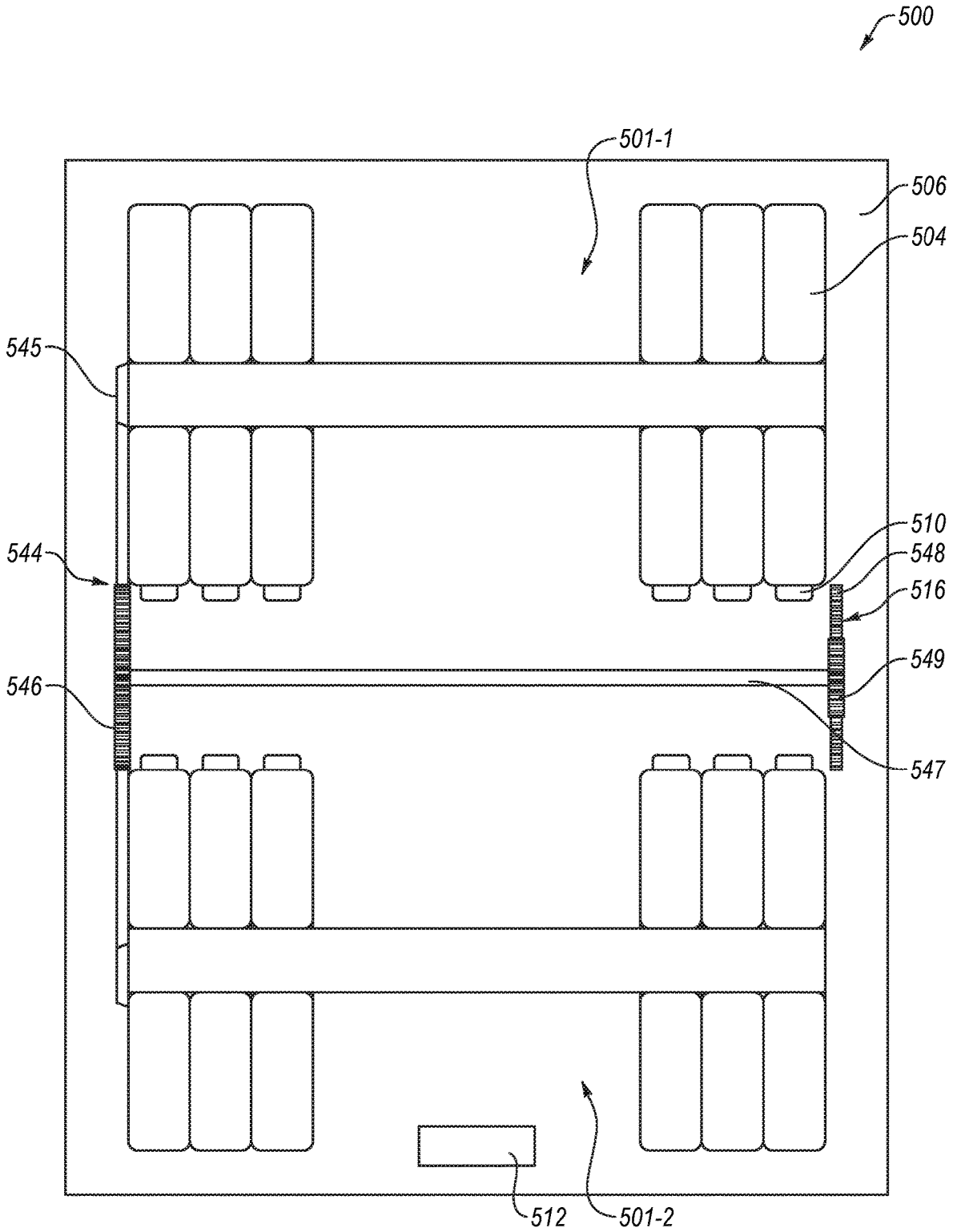
Figures 2, 5:
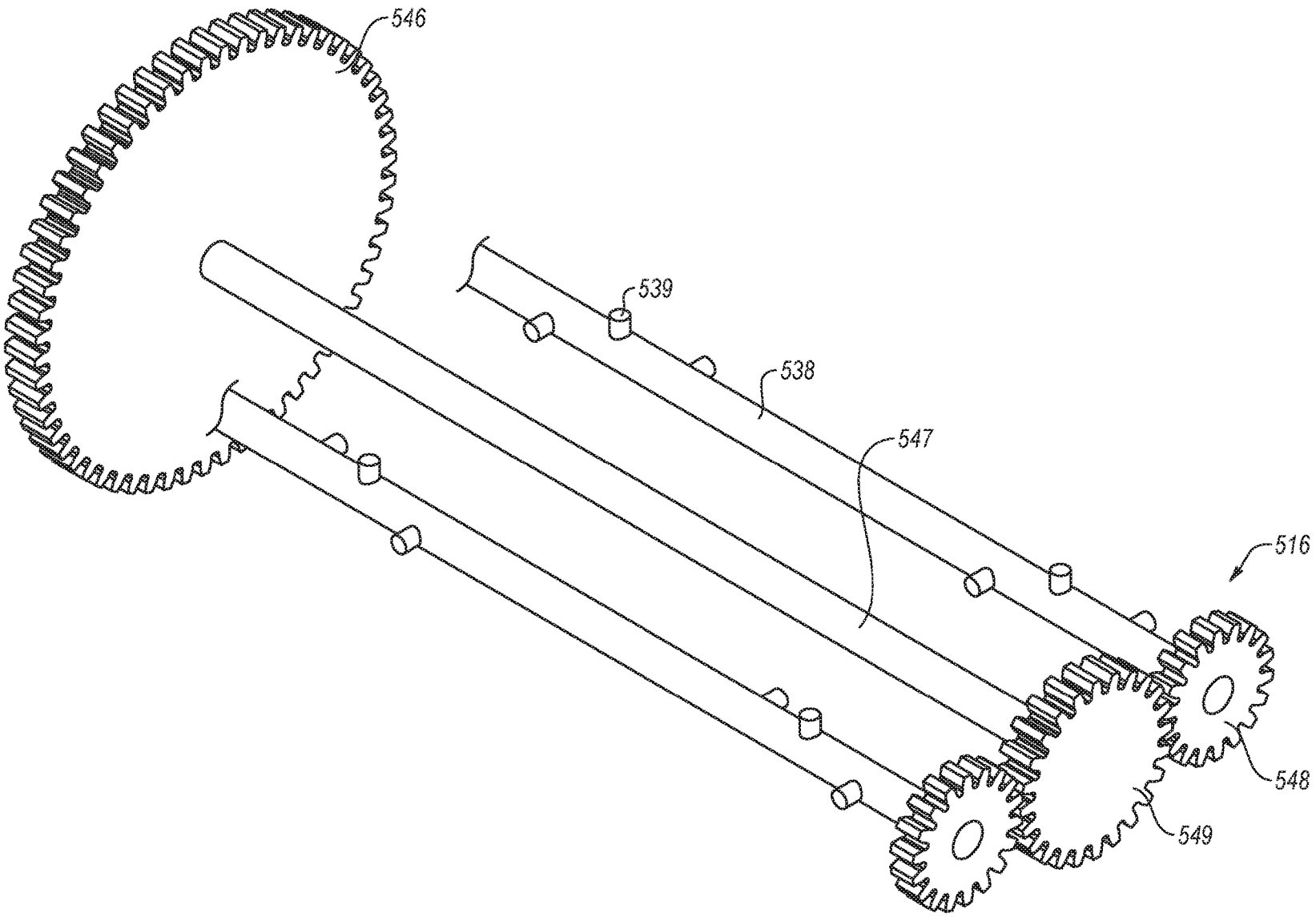

FIG. 5-1 is a top-down representation of an adjustable dumbbell system 500, according to at least one embodiment of the present disclosure. In the embodiment shown, the adjustable dumbbell system 500 includes a first dumbbell 501-1 and a second dumbbell 501-2. To change the weight of the first dumbbell 501-1 and the second dumbbell 501-2, the adjustable dumbbell system 500 includes a plate adjustment mechanism 544. The plate adjustment mechanism 544 includes a plate cam shaft gear 545 connected to a plate cam shaft (not shown). A plate primary gear 546 rotates the plate cam shaft gear, which rotates the plate cam shaft to selectively select weight plates (collectively 504) to connect to the handle (collectively 502-1). The plate primary gear 546 is connected to a primary shaft 547.

A retention mechanism 516 includes a latch cam gear 548 connected to a latch cam shaft (not shown). A latch primary gear 549 rotates the latch cam gear 548, which rotates the latch cam shaft to selectively insert a latch 510 into a notch (not shown) of a weight plate 504. The latch primary gear 549 is driven by the primary shaft 547. In this manner, the plate adjustment mechanism 544 and the retention mechanism 516 are mechanically connected. In other words, the plate adjustment mechanism 544 and the retention mechanism 516 are connected through a geared connection. For example, as the primary shaft 547 rotates, the plate cam shaft may be oriented to select one or more weight plates 504 to connect to the handle 502. The latch cam shaft may be oriented to simultaneously latch the unselected weight plates 504 to the cradle 506. A user may select the desired weight of the first dumbbell 501-1 and the second dumbbell 501-2 with the weight selection input 512, and the primary shaft 547 may be rotated until the desired weight is attached to the handles 502.

FIG. 5-2 is a perspective view of the retention mechanism 516 of FIG. 5-1. A primary shaft 547 includes a plate primary gear and a latch primary gear 549. The latch primary gear 549 rotates a latch cam gear 548 which rotates a latch cam shaft 538. Lobes 539 on the latch cam shaft 538 may then engage a latch to secure a weight plate to the a cradle.

Figure 6:
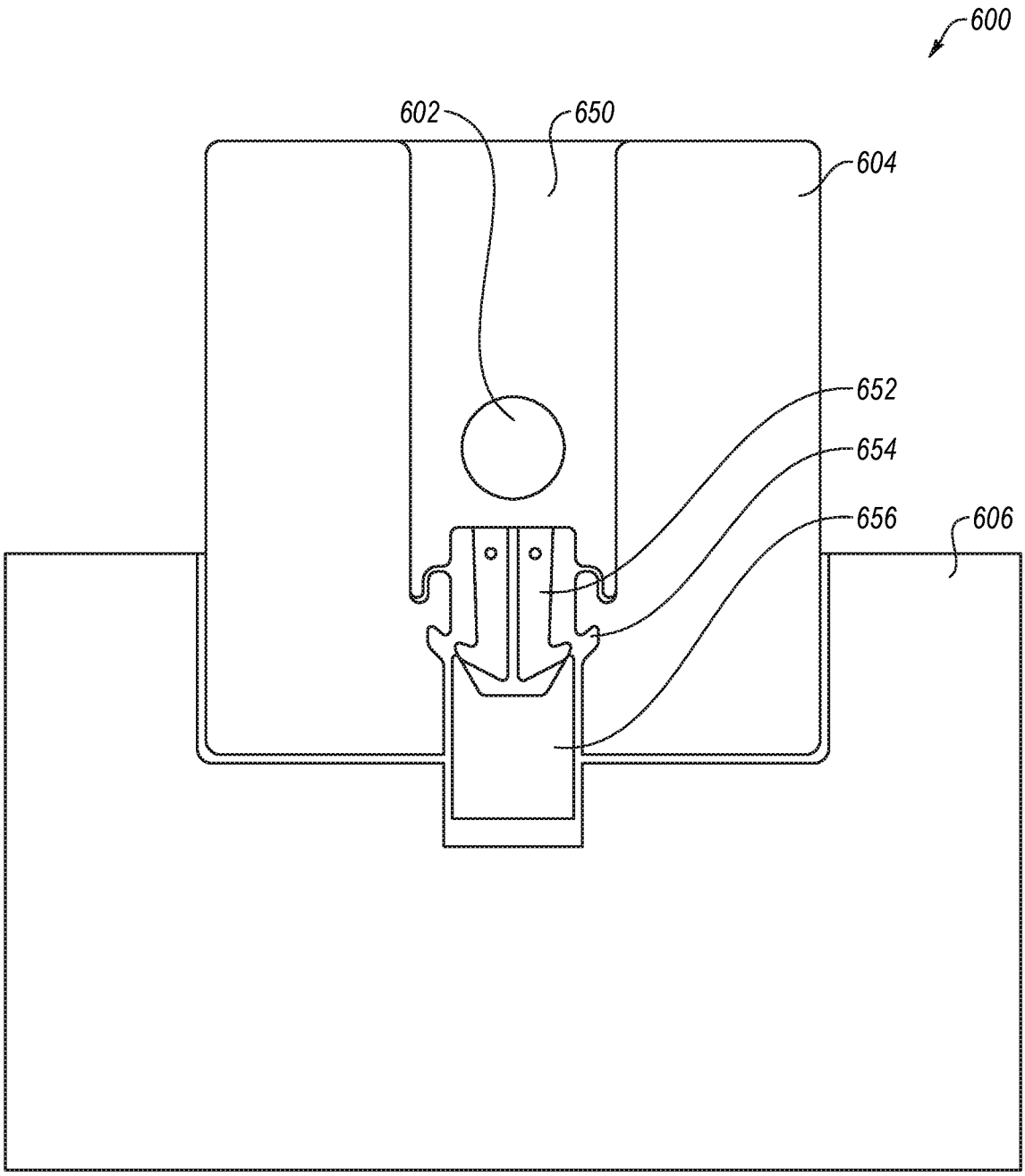
FIG. 6 is a cross-sectional view of a representation of a plate adjustment mechanism, according to at least one embodiment of the present disclosure.

FIG. 6 is a cross-sectional view of an adjustable dumbbell 600, according to at least one embodiment of the present disclosure. The adjustable dumbbell 600 includes a handle 602 and a weight plate hanger 650. The weight plate hanger 650 includes two weight plate connectors 652 that are configured to attach a weight plate 604 to the weight plate hanger 650. The weight plate connectors 652 may be inserted into weight plate supports 654 to attach the weight plate 604 to the weight plate hanger 650. A plate protrusion 656 may protrude from the cradle 606. In an upper position (i.e., the position shown), the plate protrusion 656 may pull the weight plate connecters 652 out of the weight plate supports 654, thereby detaching the weight plate 604 from the weight plate hanger 650.

Figure 7:
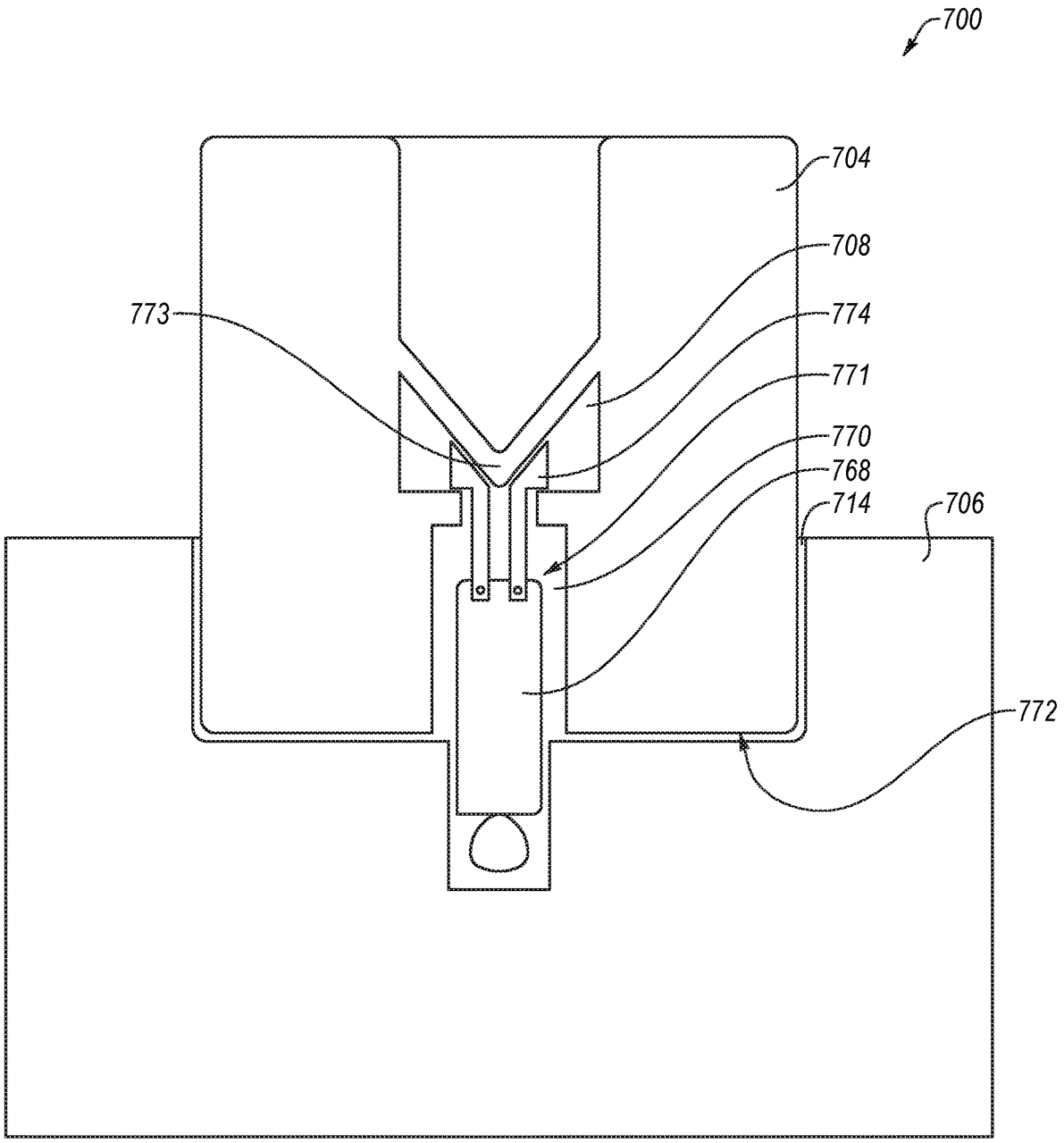
FIG. 7 is a cross-sectional view of a representation of a retention mechanism, according to at least one embodiment of the present disclosure.

FIG. 7 is a cross-sectional view of an adjustable dumbbell 700, according to at least one embodiment of the present disclosure. In the embodiment shown, a latch protrusion 768 protrudes from a weight plate receptacle 714 in a cradle 706. The latch protrusion 768 extends into a weight plate cavity 770 in the bottom surface 772 of a weight plate 704. The latch protrusion 768 includes two latch members 774 at a top end 771 of the latch protrusion 768. The latch members 774 are configured to be inserted into a notch 708 in the weight plate cavity 770. In an upper position of the latch protrusion 768, a cavity member 773 in the weight plate cavity 770 may push the latch members 774 into the notch 708 in the weight plate cavity 770, thereby securing the weight plate 704 to the cradle 706. In a lower position, the latch members 774 may not be removed from the notch 708, and the weight plate 704 may not be secured to the cradle 706.

Figure 8:
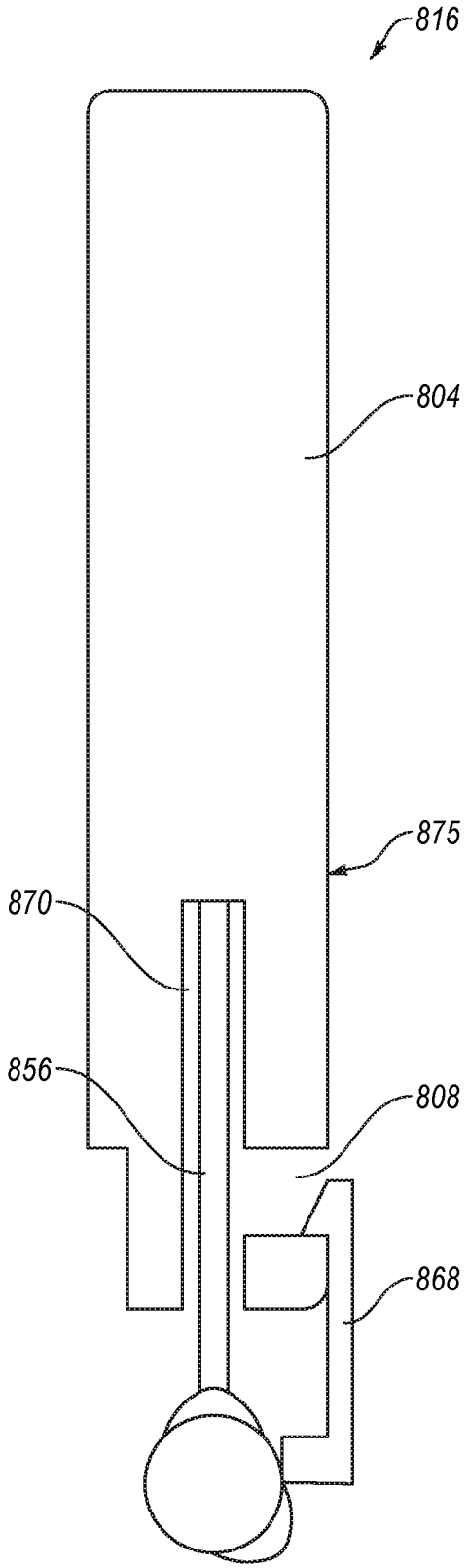
FIG. 8 is a cross-sectional view of representation of another retention mechanism, according to at least one embodiment of the present disclosure.

FIG. 8 is a cross-sectional view of a retention mechanism 816, according to at least one embodiment of the present disclosure. In the embodiment shown, a latch protrusion 868 extends upward from a cradle receptacle in a cradle. A weight plate 804 includes a notch 808 in a base surface 875 of the weight plate 804. The latch protrusion 868 may move laterally (e.g. perpendicular to the base surface 875). In the engaged position shown, the latch protrusion 868 is inserted into the notch 808, thereby securing the weight plate 804 to the cradle.

A plate protrusion 856 may extend into a weight plate cavity 870 to selectively connect the weight plate 804 to a handle (as described in reference to FIG. 6). The plate protrusion 856 and the latch protrusion 868 may both be moved by the same combined cam shaft 876. This may simplify an adjustable dumbbell system by only using a single cam shaft.

Figure 9:
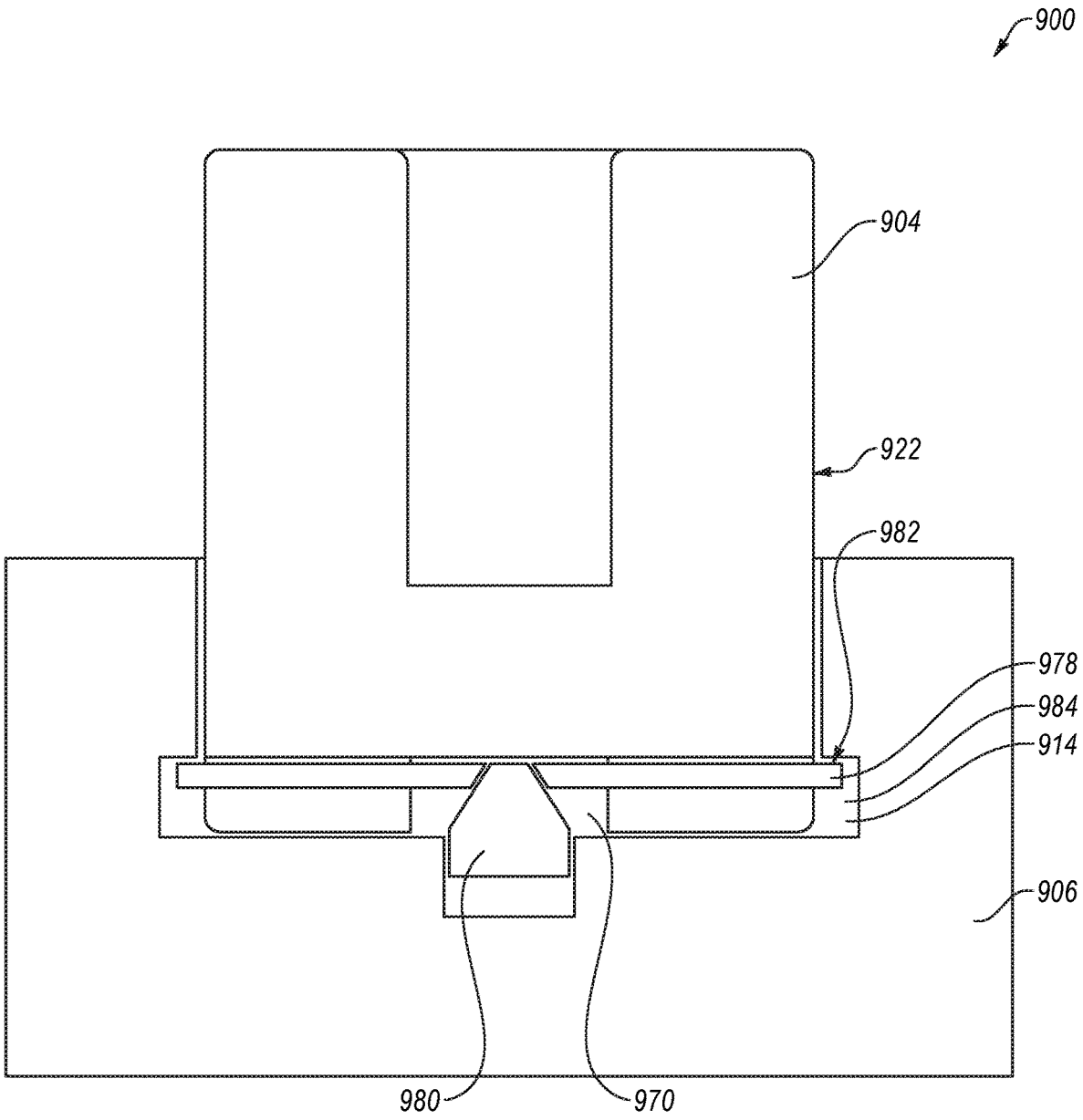
FIG. 9 is a cross-sectional view of a representation of yet another retention mechanism, according to at least one embodiment of the present disclosure.

FIG. 9 is a cross-sectional view of an adjustable dumbbell assembly 900, according to at least one embodiment of the present disclosure. In the embodiment shown, the weight plate 904 includes a weight plate cavity 970. A weight plate latch 978 may extend out of the weight plate cavity 970 and through the body of the weight plate 904. The cradle 906 includes a weight plate receptacle 914. A cradle protrusion 980 may protrude from the weight plate receptacle 914. In the upper position shown, the cradle protrusion may push the weight plate latch 978 laterally such that an outer end 982 of the weight plate latch 978 extends past the lateral face 922. The outer end 982 of the weight plate latch 978 may extend into a cradle notch 984. In this manner, the weight plate 904 may be secured to the cradle 906.

Figure 10:
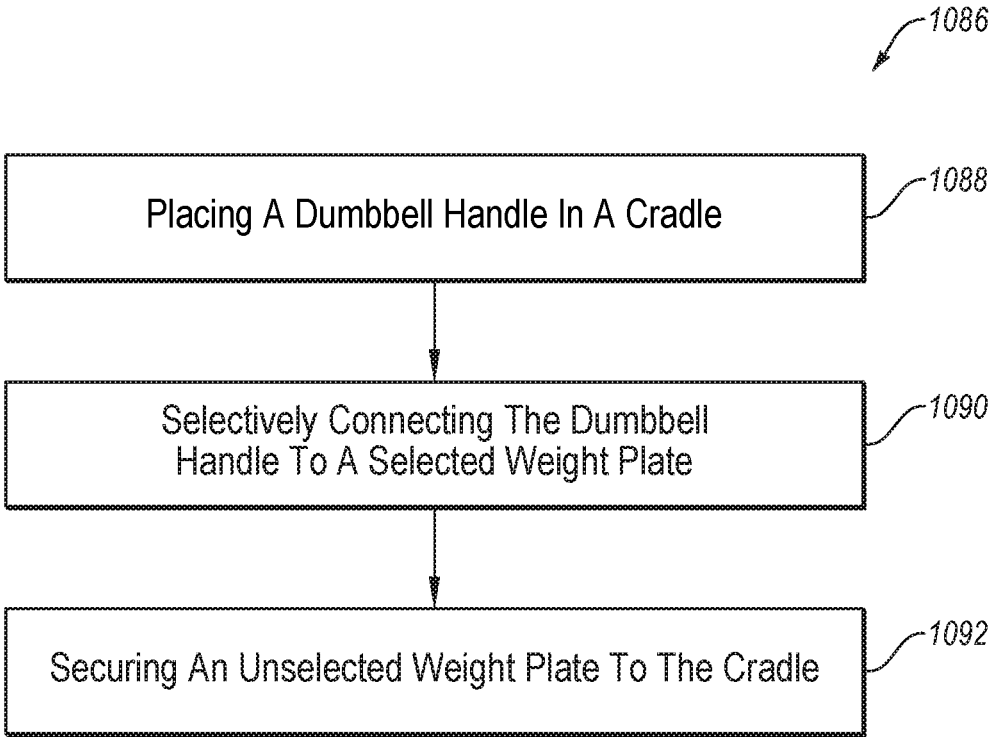
FIG. 10 is a representation of a method for securing a dumbbell, according to at least one embodiment of the present disclosure.

FIG. 10 is a representation of a method 1086 for securing an adjustable dumbbell, according to at least one embodiment of the present disclosure. The method 1086 includes placing a dumbbell handle in a cradle at 1088. The dumbbell handle may be selectively connected to one or more selected weight plates of a plurality of weight plates at 1090. One or more unselected weight plates may be secured to the cradle based on which weight plates are selected to be attached to the dumbbell handle at 1092. Securing the unselected weight plate to the cradle may include inserting a latch on the cradle into a notch in the unselected weight plate.

Figures 1, 11:
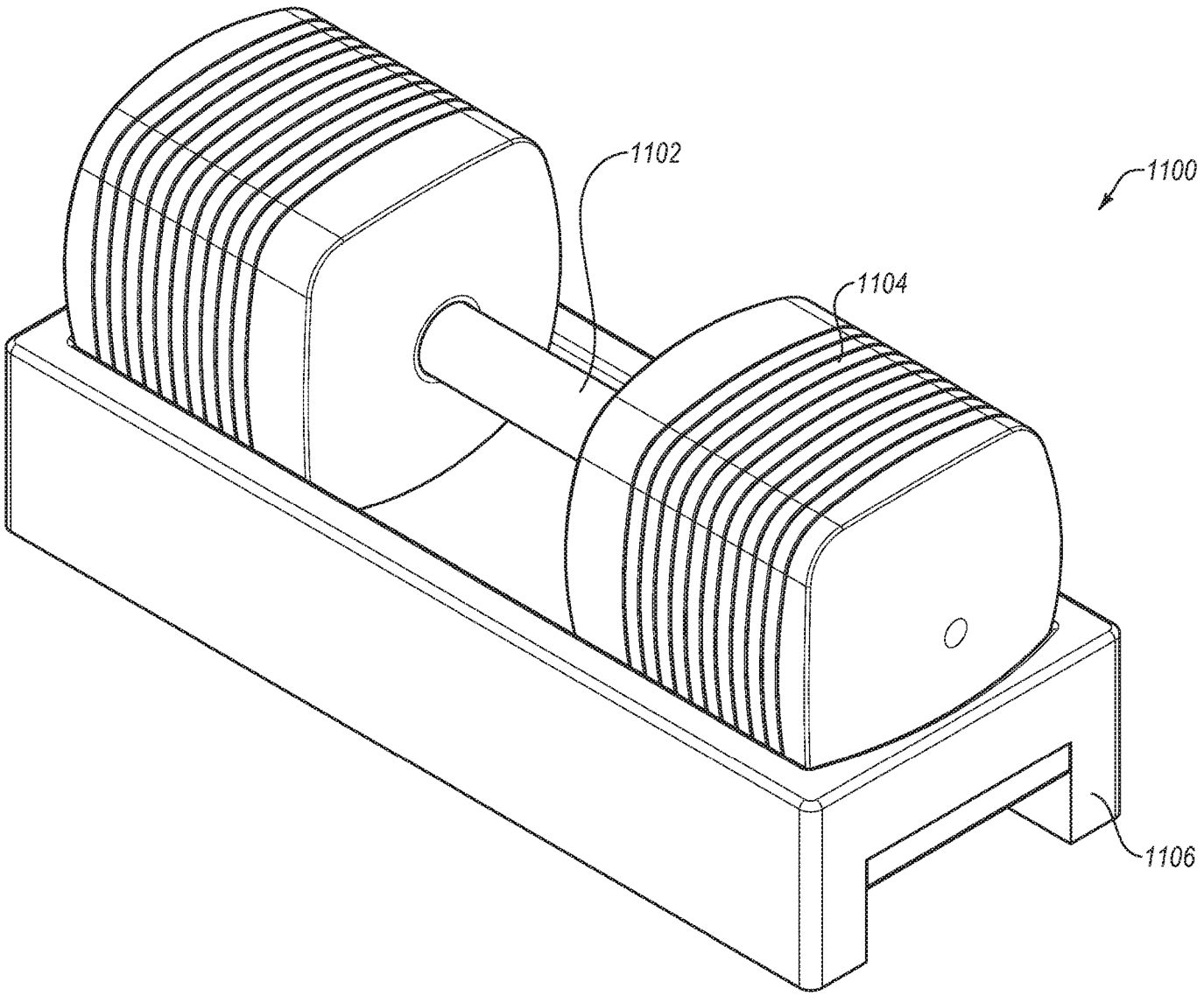
Figures 2, 11:
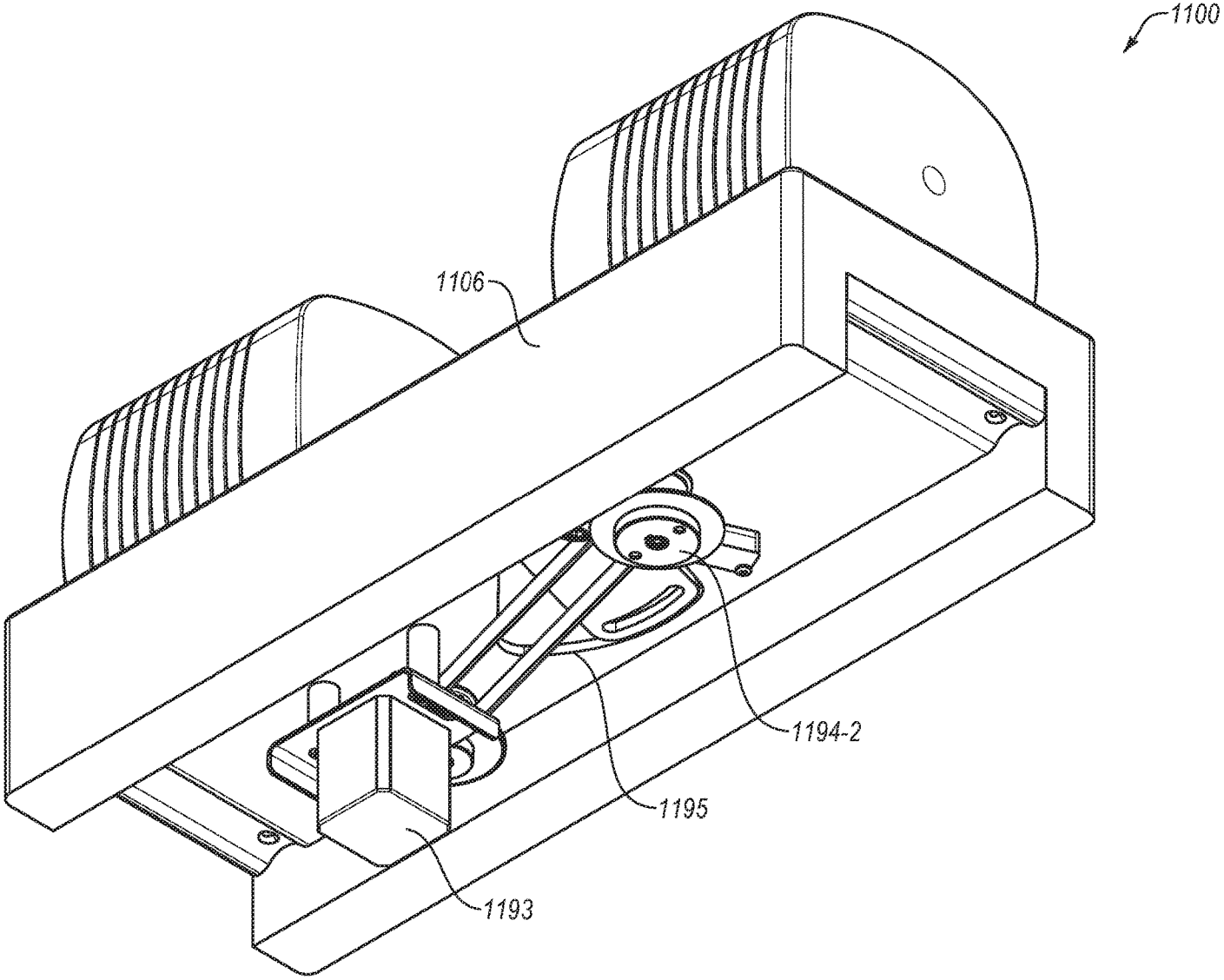
Figures 3, 11:
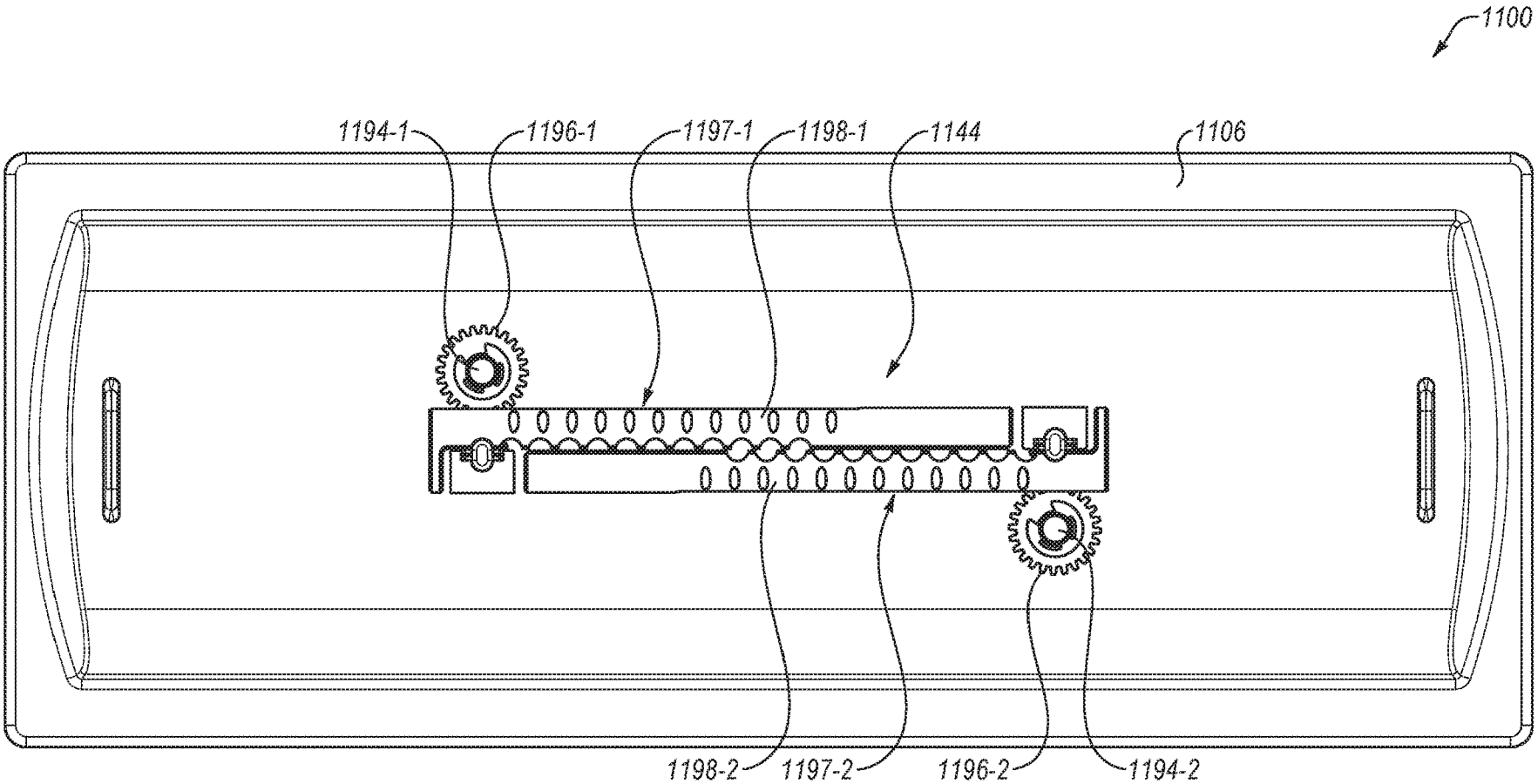
Figures 4, 11:
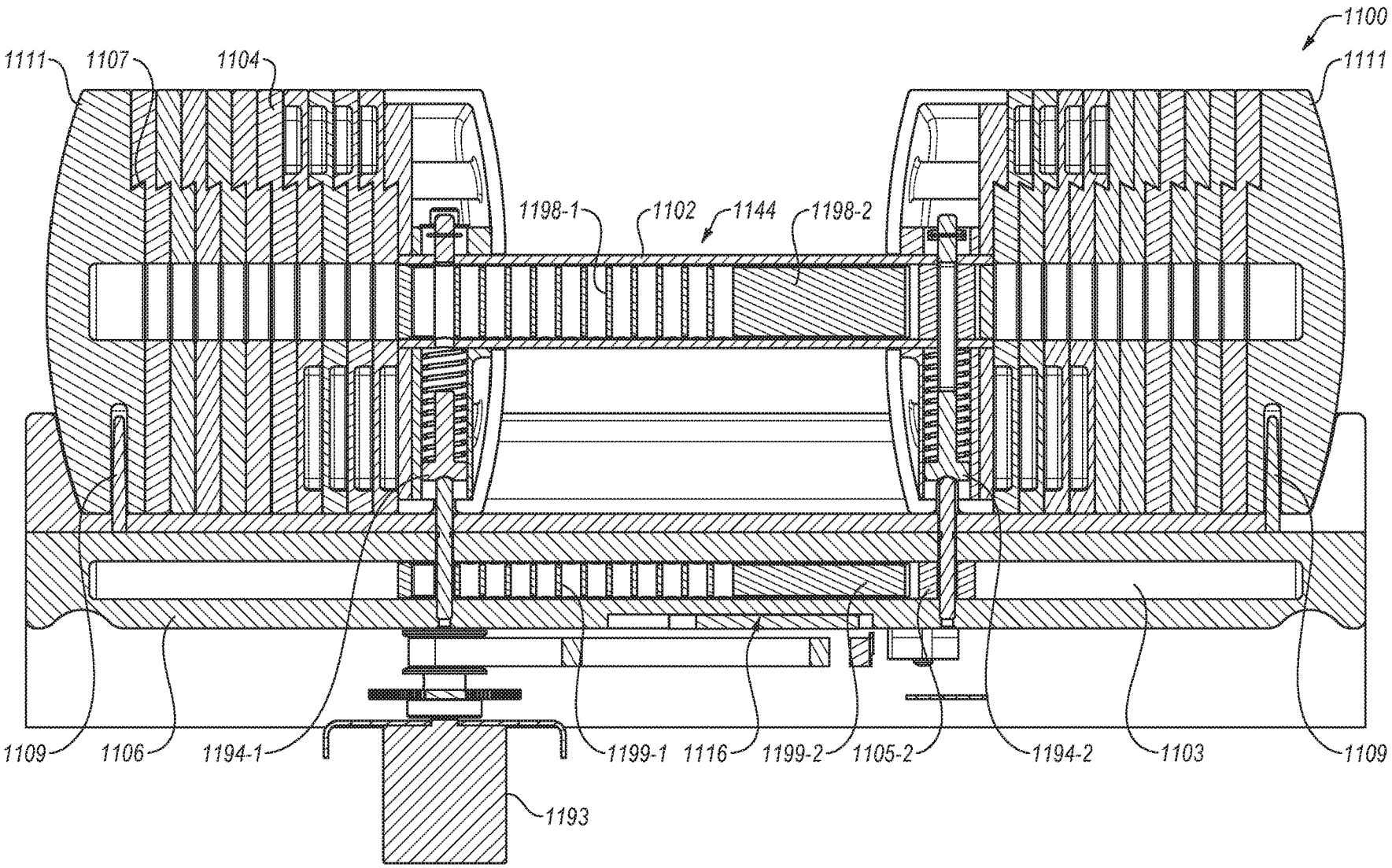

FIG. 11-1 is a perspective view of an adjustable dumbbell assembly 1100, according to at least one embodiment of the present disclosure. A cradle 1106 supports a plurality of weight plates 1104 and a handle 1102. The handle 1102 includes a plate adjustment mechanism that selectively connects the weight plates 1104 to the handle 1102. The plate adjustment mechanism is driven by a motor underneath the cradle 1106.

FIG. 11-2 is another perspective view of the adjustable dumbbell assembly 1100 of FIG. 11-1. A motor 1193 underneath the cradle 1106 may control the plate adjustment mechanism. The motor 1193 rotates a first gear shaft (not shown) and a second gear shaft 1194-2. The first gear shaft and the second gear shaft 1194-2 are connected by a plate gear belt 1195. Thus, the first gear shaft and the second gear shaft 1194-2 may rotate at the same speed.

FIG. 11-3 is a top-down view of the cradle 1106 of FIG. 11-1, including a plate adjustment mechanism 1144, according to at least one embodiment of the present disclosure. The plate adjustment mechanism includes a first gear shaft 1194-1 and a second gear shaft 1194-2. The first gear shaft 1194-1 and the second gear shaft 1194-2 are driven by the motor 1193 shown in FIG. 11-2. A first pinion gear 1196-1 is connected to the first gear shaft 1194-1 and a second pinion gear 1196-2 is connected to the second gear shaft 1194-2. The first pinion gear 1196-1 drives a first rack gear 1197-1 on a first plate extension bar 1198-1 and the second pinion gear 1196-2 drives a second rack gear 1197-2 on a second plate extension bar 1198-2.

The first plate extension bar 1198-1 and the second plate extension bar 1198-2 are extended into a series of voids in the weight plates 1104 shown in FIG. 11-1. The length of the extension of the first plate extension bar 1198-1 and the second plate extension bar 1198-2 determines the number of weight plates 1104 that are connected to the handle 1102. In this manner, by rotating the first gear shaft 1194-1 and the second gear shaft 1194-2, the weight plates 1104 may be selected.

FIG. 11-4 is a cross-sectional view of the adjustable dumbbell assembly 1100 of FIG. 11-1, according to at least one embodiment of the present disclosure. The adjustable dumbbell assembly 1100 includes a plate adjustment mechanism 1144 located in the handle 1102 and a retention mechanism 1116 in the cradle 1106. The plate adjustment mechanism 1144 and the retention mechanism 1116 are driven by the same mechanism. Specifically, the first gear shaft 1194-1 drives the first plate extension bar 1198-1 and the first retention extension bar 1199-1, and the second plate gear shaft 1194-2 drives the second plate extension bar 1198-2 and the second retention extension bar 1199-2. Thus, the plate adjustment mechanism 1144 may be mechanically coupled with the retention mechanism 1116. In other words, as the plate adjustment mechanism 1144 connects weight plates 1104 to the handle 1102, the retention mechanism 1116 may secure one or more of the unselected weight plates 1104 to the cradle 1106 in conjunction with the same operation of the motor 1193.

The cradle 1106 includes a retention mechanism slot 1103. As the first gear shaft 1194-1 rotates, a first retention pinion gear (not shown) on the first gear shaft 1194-1 may engage with a first retention rack gear on the first retention extension bar 1199-1. This may cause the first retention extension bar 1199-1 to extend into the retention mechanism slot 1103, where it may engage one or more latches. The one or more latches may engage one or more of the unselected weight plates 1104, thereby securing them to the cradle. Similarly, as the second gear shaft 1194-2 rotates, a second retention pinion gear 1105-2 on the second gear shaft 1194-2 may engage with a second retention rack gear on the second retention extension bar 1199-2. This may cause the second retention extension bar 1199-2 to extend into the retention mechanism slot 1103, where it may engage one or more latches. The one or more latches may engage one or more of the unselected weight plates 1104, thereby securing them to the cradle.

In some embodiments, each of the weight plates 1104 may be connected to each other with an interlocking connection 1107. For example, in the embodiment shown, the interlocking connection may allow the weight plates 1104 to be separated from each other using an upward force, but may prevent separation from each other using a downward or a longitudinal force (e.g., parallel to the handle 1102). In some embodiments, the interlocking connection 1107 may be a dovetail connection. In some embodiments, the interlocking connection 1107 may be any type of interlocking connection.

The interlocking connection 1107 may help to keep all of the unselected weight plates 1104 oriented in the same orientation. In this manner, the handle 1102 and the selected weight plates 1104 may be removed from the cradle 1106, and all of the unselected weight plates 1104 may remain upright in the cradle 1106. This may allow the handle 1102 and the selected weight plates 1102 to be easily re-inserted into the cradle 1106 without having to align the unselected weight plates in the cradle 1106.

In some embodiments, the retention mechanism 1116 may include a retention protrusion 1109 at either end of the cradle 1106. The retention protrusions 1109 may extend into an end weight plate 1111. The end weight plate 1111 may be connected to the other weight plates 1104 with the interlocking connection 1107. Thus, when the handle 1102 is removed, the end weight plate 1111 may remain secured to the cradle 1106, and the remaining unselected weight plates 1104 may remain oriented relative to the end weight plate 1111 via the interlocking connection 1107. Thus, the end weight plates 1111 may be the only weight plate secured to the cradle 1106, and the remaining weight plates 1104 may remain upright based on the interlocking connection 1107 to the end weight plate 1111.

In some embodiments, the retention protrusions 1109 may be rigidly attached to the cradle 1106. For example, the retention protrusions 1109 may have a height and/or position relative to the cradle 1106 that does not change based on an actuation of the plate adjustment mechanism 1144. In some embodiments, the retention protrusions 1109 may be actuated. For example, the retention protrusions 1109 may have an adjustable height, and may only extend into the end weight plate 1111 when the retention mechanism 1116 activates the retention protrusion 1109. In other examples, the end weight plate 1111 may be secured to the cradle 1106 using a latch on the lateral face of the end weight plate 1111, or any other mechanism described herein.

INDUSTRIAL APPLICABILITY

Adjustable dumbbells allow a user to exercise using a selected weight within a weight range, while reducing the need for individual dumbbells of a series of weights within the same weight range. Adjustable dumbbells include a handle or other support bar which may then have one or more weight plates selectively connected to the support bar. To increase the weight of the adjustable dumbbell, the user simply connects or attaches additional weight plates to the handle until the desired weight is reached. In some embodiments, the adjustable dumbbell may be a hand weight. For example, the handle may be sized such that a spacing between two sets of weight plates is wide enough for a single hand. In some embodiments, the adjustable dumbbell may be a long bar, such as a bar used for squats, bench press, and so forth. The long bar may have a width between sets of weight plates sufficient for widely spaced hands (e.g., greater than shoulder length apart). In some embodiments, the adjustable dumbbell may be a weight for a weight machine. In some embodiments, the adjustable dumbbell may have a single set of weight plates, such as for a kettle ball.

In some embodiments, an adjustable dumbbell may include a plate adjustment mechanism that connects selected weight plates to the adjustable dumbbell until the desired weight is reached. Regardless of how the selected weight plates are connected to the handle, a user may not always have all the weight plates simultaneously connected to the handle. Therefore, when the user removes the handle from the cradle, one or more unselected weight plates may remain behind in the cradle. These unselected weight plates may become dislodged from the cradle. In at least one embodiment, an unselected weight plate that is dislodged from the cradle may become a safety hazard, and may be dropped on a user, left on the floor to be tripped over, or present another safety hazard. Furthermore, in at least one embodiment, the unselected weight plate that is dislodged from the cradle may become misplaced. For example, the unselected weight plate may be stolen, lost, put away in the wrong plate, or otherwise misplaced.

To prevent the unselected weight plates from becoming dislodged from the cradle, the cradle may include a retention mechanism. The retention mechanism may secure the unselected weight plates to the cradle while allowing the selected weight plates to be removed from the cradle while attached to the handle. In this manner, the unselected weight plates may not become dislodged, and therefore may not be a safety hazard or misplaced. Securing the unselected weight plates to the cradle may further improve the exercise experience for the user by removing the need for the user to consciously keep track of the unselected weight plates.

The plate adjustment mechanism may be located anywhere in an adjustable dumbbell system. In some embodiments, the plate adjustment mechanism may be located in the handle of the adjustable dumbbell. A dial or gear on an outer edge of the adjustable dumbbell may rotate a shaft through the handle that includes a plurality of plate adjustment cams. The plate adjustment cams may selectively insert a pin into a notch in weight plate, thereby selecting the weight plate to be attached or connected to the handle.

In some embodiments, the adjustable dumbbell may be placed in a cradle, and the plate adjustment mechanism may be located in the cradle. The plate adjustment mechanism may include a protrusion in the cradle that extends into a cavity in a weight plate. The protrusion may have an adjustable height. In an upper position, the protrusion may push a latch on a support member connected to the handle inward, away from a notch in the cavity of the weight plate. This will decouple the weight plate from the handle. In a lower position, the protrusion may not contact the latch, and the latch may be urged into the notch in the cavity of the weight plate by a resilient member.

The cradle may include a retention mechanism including one or more latches. Each latch may be located on the cradle and selectively inserted into a notch on a weight plate. By inserting the latch into the notch, the retention mechanism may secure an unselected weight plate to the cradle. In some embodiments, each weight plate may be associated with a latch. The retention mechanism may selectively secure the latch to an associated weight plate while the adjustable dumbbell is placed in the cradle. In this manner, unselected weight plates may be secured to the cradle before the adjustable dumbbell with the selected weight plates attached to the handle is removed from the cradle. In at least one embodiment, securing the unselected weight plates to the cradle before the adjustable dumbbell is removed may help the unselected weight plates from becoming dislodged from the cradle when the adjustable dumbbell is removed. For example, the unselected weight plates may be secured to the cradle despite bumping, jostling, or friction forces on the unselected weight plates by the handle and/or the selected weight plates during removal of the handle and selected weight plates.

In some embodiments, an adjustable dumbbell may include multiple weight plates on two ends of a handle. In this manner, a user may grip the handle and move the weights while holding the handle. In some embodiments, an equal weight may be attached to the handle on either end. In some embodiments, an unequal weight may be attached to the handle. In other words, a first end of the handle may have more weight secured to it than a second end of the handle. This may occur because more weight plates are attached to the first end of the handle. In some embodiments, the retention mechanism may secure more unselected weight plates to the second end of the cradle than the first end of the cradle to match the unbalanced adjustable dumbbell.

In some embodiments, the retention mechanism may include a single latch that secures multiple weight plates to the cradle. For example, the single latch may include a bar that extends an entirety of the length of the adjustable dumbbell. In some examples, the single latch may secure some, but not all, of the weight plates to the cradle. In some embodiments, the single latch may secure two, three, four, five, six, or more weight plates to the cradle. In some embodiments, a single adjustable dumbbell may include both individual latches for each weight plate and a long, bar latch that may secure multiple weight plates to the cradle. This may increase the stability of the connection between the weight plates and the cradle, and may prevent misplacement of the weight plates and prevent the weight plates from becoming safety hazards.

In some embodiments, the weight plates are shaped like a plate. The plate has a length, a width, and a depth. In some embodiments, the length and the width may be approximately the same, such as with a square, a circle, or other equilateral polygon. In some embodiments, the length and the width may be different, such as with a rectangle, an ellipse, or other polygonal or non-polygonal structure. The length and width may be larger than the depth of the weight plate. Thus, the weight plate may represent a plate, a disc, or other planar structure. The depth may be the smallest dimension between any two faces of the weight plate.

The weight plates may include two base faces and at least one outer face that runs along an outer circumference of the weight plate. In some embodiments, the depth may be the smallest measurement between two edges of the outer face. The base faces may have any cross-sectional shape, including circular, elliptical, square, rectangular, triangular, pentagonal, hexagonal, polygonal of any side, non-polygonal, or other cross-sectional shape. The outer face may include one or more faces, depending on the number of edges of the cross-sectional shape. For example, the outer face may include an upper face, a base face opposite the upper face, and first and second lateral faces transverse to the upper face and the base face, the first lateral face being opposite the second lateral face.

Each weight plate includes a notch. The notch may be located at any location on the weight plate. In some embodiments, the notch may be located on a first base face or a second base face. In some embodiments, the notch may be located on the outer face, such as on the first lateral face, the second lateral face, both the first lateral face and the second lateral face, the top face, the cradle face, and combinations thereof. In some embodiments, the notch is an indentation, cavity, or void in the face of the weight plate. In some embodiments, the notch may be located inside a cavity in the weight plate.

The notch may have any number of edges, including 1, 2, 3, 4, 5, 6, or more sides. The edges of the notch may have any shape, including a curved edge, a straight edge, or a combination of curved and straight edges. Thus, the notch may have any shape, including hemispherical, cylindrical, triangular, square, rectangular, pentagonal, hexagonal, or any other shape.

In some embodiments, the latch of the retention mechanism includes a protrusion that extends into the notch. In some embodiments, the protrusion may be triangular, pyramidal, hemispherical, cylindrical, conical, or any other shape that may be inserted into the notch.

In some embodiments, a latch engagement surface of the latch has a complementary shape to a notch engagement surface of the notch. For example, the latch engagement surface may be flat and at a latch engagement angle. The notch engagement surface may similarly be flat and have a notch engagement angle. When activated, the notch may engage the notch at the notch engagement surface, and a majority or all of the latch engagement surface may be in contact with a majority or all of the notch engagement surface. This may increase the bearing area, which may help to increase the resistance to dislodging and/or removal of the unselected weight plates.

In some embodiments, the latch engagement angle, as measured counterclockwise relative to the lateral face, may be in a range having an upper value, a lower value, or upper and lower values including any of 45°, 60°, 75°, 80°, 85°, 90°, 95°, 100°, 105°, 120°, 135°, or any value therebetween. For example, the latch engagement angle may be greater than 45°. In another example, the latch engagement angle may be less than 135°. In yet other examples, the latch engagement angle may be any value in a range between 45° and 135°. A latch engagement angle that is close to 90° may provide the greatest force to secure the weight plate to the cradle. In some embodiments, a latch engagement angle of greater than 45° may be critical to provide sufficient force to secure the weight plate to the cradle.

In some embodiments, the notch engagement angle, as measured counterclockwise relative to the lateral face, may be in a range having an upper value, a lower value, or upper and lower values including any of 45°, 60°, 75°, 80°, 85°, 90°, 95°, 100°, 105°, 120°, 135°, or any value therebetween. For example, the notch engagement angle may be greater than 45°. In another example, the notch engagement angle may be less than 135°. In yet other examples, the notch engagement angle may be any value in a range between 45° and 135°. A notch engagement angle that is close to 90° may provide the greatest force to secure the weight plate to the cradle. In some embodiments, a notch engagement angle of less than 135° may be critical to provide sufficient force to secure the weight plate to the cradle.

In some embodiments, the latch engagement angle and the notch engagement angle are supplementary. In other words, the latch engagement angle and the notch engagement angle add up to 180°. Supplementary latch engagement angles and notch engagement angles may increase the bearing surface between the latch engagement surface and the notch engagement surface. This may increase the force with which the weight plate is secured to the cradle. In some embodiments, the latch engagement angle and the notch engagement angle are not supplementary, and may add up to an angle that is greater than or less than 180°.

In some embodiments, the latch has a complementary cross-sectional shape with the notch. Thus, when actuated, the latch may be inserted into the notch and provide resistance to removal of the unselected weight plate from the cradle. In some embodiments, the latch has a non-complementary cross-sectional shape with the notch.

In some embodiments, the latch may be located to a side of the adjustable dumbbell. In this manner, the latch may be configured connect to a notch that is on a lateral face or the top face of the weight plates. In some embodiments, a latch to the side of the adjustable dumbbell may engage the top face directly, and not a notch in the top face, to secure the weight plate to the cradle. This may allow the retention system to secure the weight plate to the cradle. Furthermore, retention system to the side of the adjustable dumbbell may allow the user to visibly verify that the latch is engaged with the weight plate.

In some embodiments, the latch may be located underneath the adjustable dumbbell. In this manner, the latch may be configured to be inserted into a cavity in the cradle surface of the weight plate and engage a notch located in the cavity. This may allow the weight plate to be secured to the cradle, and may prevent a user from tampering with the retention mechanism.

In some embodiments, the retention mechanism in the cradle may exert a force on the latch, thereby inserting the latch into and out of the notch. For example, the retention mechanism may include a retention cam shaft including a plurality of lobes. The lobes may be spaced longitudinally along the retention shaft and aligned with a latch arm on the latch. As a lobe pushes on the latch arm, the protrusion on the latch may be moved relative to the notch. Each latch may include a resilient member that urges the latch opposite the direction the lobe pushes on the latch arm (e.g., toward or away from the notch). The resilient member may include a coil spring, a torsion spring, a wave spring, a resilient foam, an elastically deformable material, any other resilient member, and combinations of the foregoing.

In some embodiments, when the lobe on the retention cam shaft pushes on the latch arm, the protrusion may be moved into the notch. In some embodiments, when the lobe on the retention cam shaft pushes on the latch arm, the protrusion may be moved away from the notch. In some embodiments, the latch arm may include a pivot. When the lobe on the retention cam shaft pushes on the latch arm, the latch arm may rotate around a pivot. Thus, when the retention cam shaft is on the dumbbell side of the latch, when the lobe pushes on the latch arm, the protrusion may be moved into the notch. When the retention cam shaft is opposite the dumbbell across the latch, when the lobe pushes on the latch arm, the protrusion may be moved away from the notch.

In some embodiments, the latch may translate (e.g., not rotate, move laterally toward/away from) with respect to the weight plate. Thus, when the retention cam shaft is on the dumbbell side of the latch, when the lobe pushes on the latch, the protrusion may be moved away from the notch. When the retention cam shaft is opposite the dumbbell across the latch, when the lobe pushes on the latch, the protrusion is moved toward the notch.

In some embodiments, the latch may be located underneath the cradle surface of the weight plate. When the adjustable dumbbell is placed on the cradle, the latch may protrude into a cavity in the cradle surface of the weight plate. The latch may include two rotating latch members. In a latch upper position, a cavity member in the cavity may push the rotating latch members into a notch in the cavity, thereby securing the weight plate to the cradle. In a latch lower position, the rotating latch members may not contact the cavity member, and the rotating latch members will not be inserted into the notch, thereby allowing the weight plate to be removed from the cradle. In some embodiments, a retention cam shaft may be located underneath the latch. A lobe on the retention cam shaft may push the latch into the upper position.

In some embodiments, the weight plate may include a base face notch in the notch of a base face. The latch may extend upward into a cavity in the weight plate. The latch may move laterally (e.g., perpendicularly toward and away from the base face notch) until the latch is engaged with the base face notch. In this manner, the latch may move horizontally to secure the weight plate to the cradle.

In some embodiments, a retention mechanism may move the latch toward or away from the notch, and may include any retention mechanism, including a cam shaft, a solenoid, a linear motor, a piezoelectric material, other linear motion devices, and combinations of the foregoing. In some embodiments, the retention mechanism may include lobes located on the cam shaft selectively and individually engage or actuate the latches. In some embodiments, the cam shaft may actuate a single latch at a time. In some embodiments, the cam shaft may actuate more than one latch at a time. In some embodiments, the cam shaft may actuate all the latches at once. In some embodiments, the cam shaft may include multiple lobes on the same circumference, which may actuate a latch at different rotational positions. In this manner, the cam shaft may actuate different combinations of latches depending on the combination of selected and unselected weight plates. In some embodiments, a plurality of latches may use the same cam shaft. In some embodiments, all the latches may use the same cam shaft. In some embodiments, multiple cam shafts may actuate multiple latches. In some embodiments, each latch may be located on the same side of the weight plates. In some embodiments, at least one latch may be located on a first side of the weight plates, and at least one latch may be located on a second side of the weight plates.

In some embodiments, as discussed above, the weight plates may be selected and attached to the handle using a plate protrusion extending from a plate receptacle into a cavity in the weight plate. Furthermore, as discussed above, the latch may protrude from the plate receptacle. Thus, each weight plate may have two protrusions extending into the weight plate. In some embodiments, the plate protrusion and the latch may extend into the same cavity in the weight plate. In some embodiments, the plate protrusion and the latch may extend into different cavities in the weight plate. In some embodiments, the plate protrusion and the latch may be actuated by the same retention mechanism. For example, the plate protrusion and the latch may be actuated using the same cam shaft, with the lobes on the cam shaft being configured to actuate both the plate protrusion and the latch. In some embodiments, the plate protrusion and the latch may be actuated by different retention mechanisms. For example, the plate protrusion may be actuated by a plate cam shaft and the latch may be actuated by a latch cam shaft.

In some embodiments, the weight plate may include plate latch, and the cradle may include a cradle notch. A protrusion may extend up from a plate receptacle and into a cavity in the weight plate. In an upper position, the protrusion may push one or more plate latches laterally outward. The one or more plate latches may extend into the cradle notch. Thus, when the adjustable dumbbell is removed, the unselected weight plate may be secured to the cradle with the plate latch inserted into the cradle notch. In some embodiments, a retention mechanism may be located underneath the latch and move the latch between the upper and lower position. In some embodiments, the weight plate may include both a plate latch and a notch, and the cradle may include a latch and a cradle notch. This may provide additional strength to the contact between the weight plate and the cradle, thereby providing additional protection from dislodging the weight plate from the cradle.

In some embodiments, each latch of the plurality of latches may have an associated retention mechanism. This may allow for many different combinations of engaged latches, and therefore many different combinations of weight plates that are secured to the cradle. This may increase the versatility of the adjustable dumbbell, which may improve the user experience. In some embodiments, multiple latches may use the same retention mechanism. This may simplify the cradle assembly, which may improve reliability and decrease manufacturing costs.

In some embodiments, the plate adjustment mechanism may be mechanically connected to the retention mechanism. In this manner, as the selected weight plates are connected to the handle or the bar support, the unselected weight plates may be automatically secured to the cradle. For example, an adjustable dumbbell may include at least two weight plates. A user may select a desired weight for the adjustable dumbbell with a weight selection input on the cradle, the dumbbell, the handle, or other location. The user may cause the plate adjustment mechanism to select a first weight and connect it to the handle. Using the plate adjustment mechanism may mechanically activate the retention mechanism, which may secure the unselected weight plate to the cradle. In at least one embodiment, mechanically connecting the plate adjustment mechanism to the retention mechanism may simplify the use of the adjustable dumbbell by allowing the user to focus on selecting and using the desired weight plates, without worrying about securing the unselected weight plates or worrying about safety hazards from unselected weight plates.

In some embodiments, the plate adjustment mechanism may include a combined cam shaft to connect weight plates to the handle, and retention mechanism use the same combined cam shaft to engage the latches in the notches of the weight plates, thereby securing the weight plates to the handle. In some embodiments, the plate adjustment mechanism may include a plate cam shaft in the handle of the adjustable dumbbell. The plate cam shaft may be rotated by a plate gear on a primary shaft. A latch cam shaft may selectively engage the latches with the weight plates. The latch cam shaft may be rotated by a latch gear. In some embodiments, the latch gear may be on the same primary shaft as the plate gear. In some embodiments, the latch gear may be located on a secondary shaft that is connected to the primary shaft with a geared connection. Furthermore, this may help to prevent mistakenly securing unselected weight plates to the cradle. Still further, this may help to prevent mistakenly failing to secure an unselected weight plate, which may then become misplaced or become a safety hazard.

In some embodiments, the cradle may include weight plate receptacles, a plate adjustment mechanism, and a retention mechanism sufficient to operate single adjustable dumbbell. In some embodiments, the cradle may include weight plate receptacles, plate adjustment mechanisms, and retention mechanisms sufficient to operate single adjustable dumbbell. In some embodiments, plate adjustment mechanism and the retentions mechanism for multiple adjustable dumbbells may be operated by the same driving force, such as a primary shaft. This may simplify the dumbbell adjustment process for the user. Furthermore, this may help to prevent mistakenly securing unselected weight plates to the cradle. Still further, this may help to prevent mistakenly failing to secure an unselected weight plate, which may then become misplaced or become a safety hazard.

In some embodiments, a method for securing an adjustable dumbbell includes placing a dumbbell handle in a cradle. The dumbbell handle may be selectively connected to one or more selected weight plates of a plurality of weight plates. One or more unselected weight plates may be secured to the cradle based on which weight plates are selected to be attached to the dumbbell handle. Securing the unselected weight plate to the cradle may include inserting a latch on the cradle into a notch in the unselected weight plate. Securing the unselected weight plates to the cradle may further include inserting a protrusion into a cavity in the unselected weight plate, the protrusion including a latch that connects to a notch in the cavity.

The method may further include selecting the selected weight plate and identifying the unselected weight plate as any weight plate of the plurality of weight plates that is not the selected weight plate. In other words, the total number of weight plates may be divided into selected weight plates connected or attached to the dumbbell handle, and unselected weight plates secured to the cradle.

In some embodiments, an adjustable dumbbell may include a rack and pinion plate adjustment mechanism. A motor may be located in the cradle and a shaft may extend through the cradle and connect to a gear housing. The gear housing may include a pinion gear. The handle may be hollow and include an extension arm. A rack gear (e.g., a linear gear) may be located inside the hollow handle. The rack gear may be connected to the pinion gear. As the pinion gear rotates, the rack gear may extend the extension arm.

Each weight plate may include a void through which the extension arm may extend. The length of extension of the extension arm may determine the number of selected weight plates, and therefore the total weight, of the adjustable dumbbell. The motor may also be connected to a retention mechanism including a rack and pinion gear in the cradle, which may extend a latch arm. The latch arm may cause latches to engage/disengage with notches on the weight plates corresponding to the selected and unselected weight plates. Thus, the plate adjustment mechanism and the retention mechanism may be connected through a geared connection.

In some embodiments, a cradle supports a plurality of weight plates and a handle. The handle includes a plate adjustment mechanism that selectively connects the weight plates to the handle. The plate adjustment mechanism is driven by a motor underneath the cradle.

A motor underneath the cradle may control the plate adjustment mechanism. The motor rotates a first gear shaft and a second gear shaft. The first gear shaft and the second gear shaft are connected by a plate gear belt. Thus, the first gear shaft and the second gear shaft may rotate at the same speed.

The plate adjustment mechanism includes a first gear shaft and a second gear shaft. The first gear shaft and the second gear shaft are driven by the motor. A first pinion gear is connected to the first gear shaft and a second pinion gear is connected to the second gear shaft. The first pinion gear drives a first rack gear on a first plate extension bar and the second pinion gear drives a second rack gear on a second plate extension bar.

The first plate extension bar and the second plate extension bar are extended into a series of voids in the weight plates. The length of the extension of the first plate extension bar and the second plate extension bar determines the number of weight plates that are connected to the handle. In this manner, by rotating the first gear shaft and the second gear shaft, the weight plates may be selected.

The adjustable dumbbell assembly includes a plate adjustment mechanism located in the handle and a retention mechanism in the cradle. The plate adjustment mechanism and the retention mechanism are driven by the same mechanism. Specifically, the first gear shaft drives the first plate extension bar and the first retention extension bar, and the second plate gear shaft drives the second plate extension bar and the second retention extension bar. Thus, the plate adjustment mechanism may be mechanically coupled with the retention mechanism. In other words, as the plate adjustment mechanism connects weight plates to the handle, the retention mechanism may secure one or more of the unselected weight plates to the cradle in conjunction with the same operation of the motor.

The cradle includes a retention mechanism slot. As the first gear shaft rotates, a first retention pinion gear (not shown) on the first gear shaft may engage with a first retention rack gear on the first retention extension bar. This may cause the first retention extension bar to extend into the retention mechanism slot, where it may engage one or more latches. The one or more latches may engage one or more of the unselected weight plates, thereby securing them to the cradle. Similarly, as the second gear shaft rotates, a second retention pinion gear on the second gear shaft may engage with a second retention rack gear on the second retention extension bar. This may cause the second retention extension bar to extend into the retention mechanism slot, where it may engage one or more latches. The one or more latches may engage one or more of the unselected weight plates, thereby securing them to the cradle.

In some embodiments, each of the weight plates may be connected to each other with an interlocking connection. For example, in the embodiment shown, the interlocking connection may allow the weight plates to be separated from each other using an upward force, but may prevent separation from each other using a downward or a longitudinal force (e.g., parallel to the handle). In some embodiments, the interlocking connection may be a dovetail connection. In some embodiments, the interlocking connection may be any type of interlocking connection.

The interlocking connection may help to keep all of the unselected weight plates oriented in the same orientation. In this manner, the handle and the selected weight plates may be removed from the cradle, and all of the unselected weight plates may remain upright in the cradle. This may allow the handle and the selected weight plates to be easily re-inserted into the cradle without having to align the unselected weight plates in the cradle.

In some embodiments, the retention mechanism may include a retention protrusion at either end of the cradle. The retention protrusions may extend into an end weight plate. The end weight plate may be connected to the other weight plates with the interlocking connection. Thus, when the handle is removed, the end weight plate may remain secured to the cradle, and the remaining unselected weight plates may remain oriented relative to the end weight plate via the interlocking connection. Thus, the end weight plates may be the only weight plate secured to the cradle, and the remaining weight plates may remain upright based on the interlocking connection to the end weight plate.

In some embodiments, the retention protrusions may be rigidly attached to the cradle. For example, the retention protrusions may have a height and/or position relative to the cradle that does not change based on an actuation of the plate adjustment mechanism. In some embodiments, the retention protrusions may be actuated. For example, the retention protrusions may have an adjustable height, and may only extend into the end weight plate when the retention mechanism activates the retention protrusion. In other examples, the end weight plate may be secured to the cradle using a latch on the lateral face of the end weight plate, or any other mechanism described herein.

Below are sections of the current disclosure:

1. A system for securing an adjustable dumbbell, comprising:
   - a handle;
   - a plate adjustment mechanism configured to selectively connect a selected weight plate of a plurality of weight plates to the handle, each weight plate of the plurality of weight plates including an engagement surface;
   - a cradle configured to receive the plurality of weight plates, the cradle including a latch; and
   - a retention mechanism configured to selectively engage the latch with the engagement surface of an unselected weight plate of the plurality of weight plates, wherein the plate adjustment mechanism is mechanically connected to the retention mechanism.
2. The system of section 1, wherein the plate adjustment mechanism is located in the cradle.
3. The system of section 1 or section 2, wherein the retention mechanism inserts a protrusion on the latch into a notch having the engagement surface.
4. The system of any of section 1 through 3, wherein the plate adjustment mechanism is connected to the retention mechanism with a geared connection.

5. The system of section 4, wherein the plate adjustment mechanism includes a plate cam shaft and the retention mechanism includes a latch cam shaft, and wherein the plate cam shaft and the latch cam shaft are driven by a primary shaft.

6. A system for securing an adjustable dumbbell, comprising:

a handle;

a plurality of weight plates removably connected to the handle, each weight plate of the plurality of weight plates including a notch; and a cradle including:

a plurality of weight plate receptacles configured to receive each weight plate of the plurality of weight plates; and a plurality of latches configured to be selectively inserted into the notch located on each weight plate of the plurality of weight plates, wherein the plurality of latches are individually actuated.

7. The system of section 6, wherein each weight plate receptacle includes a latch of the plurality of latches.

8. The system of section 7, further comprising a plurality of protrusions extending from the weight plate receptacles, and wherein each weight plate of the plurality of weight plates includes a cavity, a protrusion from the plurality of protrusions extending into the cavity.

9. The system of section 8, wherein each protrusion of the plurality of protrusions includes a latch of the plurality of latches, and wherein the cavity includes the notch.

10. The system of any of sections 6 through section 9, wherein the notch is located on an outer face of each weight plate of the plurality of weight plates.

11. The system of section 10, wherein the notch is located on a lateral face of each weight plate of the plurality of weight plates.

12. The system of section 11, wherein the notch is a first notch, and each weight plate of the plurality of weight plates includes a second notch.

13. The system of section 12, wherein each weight plate of the plurality of weight plates is secured to the cradle with a first latch of the plurality of latches inserted into the first notch and a second latch of the plurality of latches inserted into the second notch.

14. The system of any of sections 11 through 13, wherein a single latch is inserted into the notch of two weight plates of the plurality of weight plates.

15. The system of section 14, wherein the single latch includes a bar that extends along a length of the handle.

16. The system of any of sections 10 through 15, wherein the notch is located on a top face of at least one weight plate of the plurality of weight plates.

17. A method for securing an adjustable dumbbell, comprising:

placing a dumbbell handle in a cradle;

selectively connecting the dumbbell handle to a selected weight plate of a plurality of weight plates; and securing an unselected weight plate of the plurality of weight plates to the cradle based on the selected weight plate connected to the dumbbell handle.

18. The method of section 17, further comprising:

selecting the selected weight plate; and identifying the unselected weight plate as any weight plate of the plurality of weight plates that is not the selected weight plate.

19. The method of section 17 or section 18, wherein securing the unselected weight plate includes inserting a latch into a notch in the unselected weight plate.

20. The method of any of sections 17 through 19, wherein securing the unselected weight plate includes inserting a weight plate latch on the weight plate into a cradle notch on the cradle.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately,"

"about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A system for securing an adjustable dumbbell, comprising:

a handle;

a plate adjustment mechanism configured to selectively connect a selected weight plate of a plurality of weight plates to the handle, each weight plate of the plurality of weight plates including an engagement surface;

a cradle configured to receive the plurality of weight plates, the cradle including a latch; and a retention mechanism configured to selectively engage the latch with the engagement surface of an unselected weight plate of the plurality of weight plates, wherein an actuation of the plate adjustment mechanism mechanically actuates the retention mechanism in the cradle.

2. The system of claim 1, wherein the plate adjustment mechanism is located in the cradle.

3. The system of claim 1, wherein the retention mechanism inserts a protrusion on the latch into a notch having the engagement surface.

4. The system of claim 1, wherein the plate adjustment mechanism is connected to the retention mechanism with a geared connection.

5. The system of claim 4, wherein the plate adjustment mechanism includes a plate cam shaft and the retention mechanism includes a latch cam shaft, and wherein the plate cam shaft and the latch cam shaft are driven by a primary shaft.

6. A system for securing an adjustable dumbbell, comprising:

a handle;

a plurality of weight plates removably connected to the handle, each weight plate of the plurality of weight plates including a notch; and a cradle including:

a plate adjustment mechanism to selectively connect the plurality of weight plates to the handle;

a plurality of weight plate receptacles configured to receive each weight plate of the plurality of weight plates; and a plurality of latches configured to be selectively inserted into the notch located on each weight plate of the plurality of weight plates, wherein the plurality of latches are individually actuated based on the plate adjustment mechanism.

7. The system of claim 6, wherein each weight plate receptacle includes a latch of the plurality of latches.

8. The system of claim 6, further comprising a plurality of protrusions extending from the weight plate receptacles, and wherein each weight plate of the plurality of weight plates includes a cavity, a protrusion from the plurality of protrusions extending into the cavity.

9. The system of claim 8, wherein each protrusion of the plurality of protrusions includes a latch of the plurality of latches, and wherein the cavity includes the notch.

10. The system of claim 6, wherein the notch is located on an outer face of each weight plate of the plurality of weight plates.

11. The system of claim 10, wherein the notch is located on a lateral face of each weight plate of the plurality of weight plates.

12. The system of claim 11, wherein the notch of each weight plate of the plurality of weight plates is a first notch, and each weight plate of the plurality of weight plates includes a second notch.

13. The system of claim 12, wherein each weight plate of the plurality of weight plates is secured to the cradle with a first latch of the plurality of latches inserted into the first notch and a second latch of the plurality of latches inserted into the second notch.

14. The system of claim 11, wherein a single latch is inserted into the notch of two weight plates of the plurality of weight plates.

15. The system of claim 14, wherein the single latch includes a bar that extends along a length of the handle.

16. The system of claim 10, wherein the notch is located on a top face of at least one weight plate of the plurality of weight plates.

17. A method for securing an adjustable dumbbell, comprising:

placing a dumbbell handle in a cradle;

selectively connecting the dumbbell handle to a selected weight plate of a plurality of weight plates using a plate adjustment mechanism in the cradle; and securing an unselected weight plate of the plurality of weight plates to the cradle based on the selected weight plate connected to the dumbbell handle using a retention mechanism in the cradle, wherein an actuation of the retention mechanism is coupled to an actuation of the plate adjustment mechanism.

18. The method of claim 17, further comprising:

selecting the selected weight plate; and identifying the unselected weight plate as any weight plate of the plurality of weight plates that is not the selected weight plate.

19. The method of claim 17, wherein securing the unselected weight plate includes inserting a latch into a notch in the unselected weight plate.

20. The method of claim 17, wherein securing the unselected weight plate includes inserting a weight plate latch on the weight plate into a cradle notch on the cradle.

* * * * *